US006535189B1

(12) United States Patent
Akiyama et al.

(10) Patent No.: US 6,535,189 B1
(45) Date of Patent: Mar. 18, 2003

(54) LIQUID CRYSTAL DISPLAY DEVICE HAVING AN IMPROVED GRAY-SCALE VOLTAGE GENERATING CIRCUIT

(75) Inventors: Kenichi Akiyama, Higashimurayama (JP); Yuji Yamashita, Chiba (JP); Hironobu Isami, Chiba (JP); Mitsuru Goto, Chiba (JP); Shinji Yasukawa, Chousei (JP); Koichi Kotera, Kokubunji (JP)

(73) Assignees: Hitachi ULSI Systems Co., Ltd., Kodaira (JP); Hitachi Device Engineering Co., Ltd., Mobara (JP); Hitachi, Ltd., Tokyo (JP)

( * ) Notice: Subject to any disclaimer, the term of this patent is extended or adjusted under 35 U.S.C. 154(b) by 342 days.

(21) Appl. No.: 09/621,699

(22) Filed: Jul. 21, 2000

(30) Foreign Application Priority Data

Jul. 21, 1999 (JP) ..... 11-206468

(51) Int. Cl.[7] ..... G09G 3/36

(52) U.S. Cl. ..... 345/87; 345/90; 345/99; 345/100

(58) Field of Search ..... 345/87, 89, 90, 345/99, 100

(56) References Cited

U.S. PATENT DOCUMENTS 5,625,387 A * 4/1997 Moon ..... 345/209

6,151,005 A * 11/2000 Takita et al. ..... 345/89

* cited by examiner

*Primary Examiner*—Steven Saras
*Assistant Examiner*—Uchendu O. Anyaso
(74) *Attorney, Agent, or Firm*—Antonelli, Terry, Stout, & Kraus, LLP

(57) ABSTRACT

A liquid crystal display device includes a liquid crystal panel having plural pixels and a video signal line driver circuit for supplying a video signal voltage to each of the pixels via a corresponding one of plural video lines in accordance with a P-bit display data. The video signal line driver circuit includes a power supply circuit for supplying Q different gray-scale voltages, plural selector circuits corresponding to the video lines, each of the selector circuits for outputting one of first and second pairs of voltages in accordance with the display data, the first pair being two voltages equal to a same one selected from among the Q different gray-scale voltages, the second pair being two different voltages selected from among the Q different gray-scale voltages, and plural amplifiers corresponding to the video lines, each of the amplifiers for outputting the video signal voltage to a corresponding one of the video lines based upon one of the first and second pairs of voltages or a voltage intermediate between the second pair of voltages and produced from the second pair of voltages in the amplifiers.

13 Claims, 25 Drawing Sheets

FIRST DECODER

B-V CURVE

DRIVER OUTPUT VOLTAGE

GRAY-SCALE LEVELS

V000
V001
V002
V003
V004
V005
V006
V007
V008
V009
V010
V011
V012
V013
V014
V015
V030
V031
V032
V033
V034
V035
V036
V037
V038
V039
V040
V041
V042
V043
V044
V045
V046
V047
V048
V049
V050
V051
V052
V053
V054
V055
V056
V057
V058
V059
V060
V061
V062
V063
CKT A
A
B
C
D
CKT B
CKT C
CKT D
YB
D0N
D0P
D1N
D1P
D2N
D2P
D3N
D3P
D4N
D4P
D5N
D5P
D6N
D6P
D7N
D7P

LIQUID CRYSTAL DISPLAY DEVICE HAVING AN IMPROVED GRAY-SCALE VOLTAGE GENERATING CIRCUIT

BACKGROUND OF THE INVENTION

The present invention relates to a liquid crystal display device, and more particularly to a liquid crystal display device capable of a multi-gray scale display and used as a displaying means for a personal computer, a work station or the like.

Liquid crystal display devices are widely used as a display device for office automation equipment such as a personal computer. Liquid crystal display devices are divided roughly into a simple matrix type which forms pixels using intersections of intersecting stripe-shaped electrodes and an active matrix type which is provided with an active element such as a thin film transistor (TFT) at each pixel and switches the active element ON or OFF.

The active matrix type liquid crystal display device has a TFT-type liquid crystal panel, a scanning-signal line driver circuit (sometimes referred to as a gate driver) for supplying a scanning voltage to each of scanning signal lines (gate lines) of the liquid crystal panel, a video-signal line driver circuit (sometimes referred to as a drain driver) for supplying video signal voltages to video-signal lines (drain lines), a display control device for supplying various kinds of control signals and display data provided from a host computer such as a personal computer to the gate driver and the drain driver as display signals, and an internal power supply circuit.

FIG. 24 is a block diagram for explaining a rough configuration of a liquid crystal display device to which the present invention is applied. A liquid crystal panel 281 of the liquid crystal display device is an active-matrix type liquid crystal panel using thin-film transistors (a TFT LCD), and a plurality of drain drivers 282 and a plurality of gate drivers 283 are disposed along the top side of the liquid crystal panel 281.

The liquid crystal panel 281 comprises 1024×768 pixels, for example, each of which comprises three-color sub-pixels, red (R), green (G) and blue (B) sub-pixels.

A display control device 285 receives a display data (a video signal) in three colors of red (R), green (G) and blue (B), and control data including a clock signal, a display timing signal and a synchronizing signal from a host computer such as a personal computer via an interface connector 284.

The display control device 285 generates data in a display format of the liquid crystal panel based upon the control signal, and supplies them to the drain drivers 282 via data bus, and simultaneously with this, supplies timing signals such as a display start timing clock, a line clock and a pixel clock (a carry signal, CL1 and CL2) to the drain drivers 282.

An internal power supply circuit 286 generates reference voltages (V9 to V0) for generating gray scale display voltages and supplies them to the drain drivers 282, and supplies a scanning voltage (a gate voltage) to the gate drivers 283.

Each of the drain drivers 282 is allotted to a group comprised of a given number of video signal lines (drain lines), and outputs a carry signal to a succeeding one of the drain drivers 282 when the count reaches the above given number.

The drain drivers 282 each include a gray-scale generating circuit for generating a gray-scale voltage based upon a display data, and an amplifier for amplifying the generated gray-scale voltage and supplying a video signal voltage corresponding to the display data to a corresponding one of the drain lines.

In a liquid crystal display device of the TFT type, it is necessary to reverse the polarity of a video signal voltage applied to a drain line with respect to a voltage (hereinafter VCOM) applied to a counter electrode which opposes pixel electrodes from frame to frame, so as to prevent "burning" of the liquid crystal layer. For this polarity reversal, there are a VCOM AC driving method which reverses polarities of both two voltages applied to a pixel electrode and a counter electrode, respectively, and a dot-polarity inversion drive method which changes greatly a voltage applied to a pixel electrode with a fixed voltage applied to the counter electrode.

Such prior art techniques for the liquid crystal display devices are disclosed in Japanese Patent Application Laid-open No. Hei 9-281930 (laid-open on Oct. 31, 1997 and corresponding to U.S. Pat. No. 5,995,073 issued on Nov. 30, 1999), for example.

SUMMARY OF THE INVENTION

Recently, there is a tendency for the TFT active matrix type liquid crystal display device to be made larger in size of the liquid crystal panel, increase image resolution, improve image quality, and reduce power consumption. Further, it is desired that a useless space and the border areas around a display area are minimized to achieve aesthetic qualities of the display device.

It is essential that the cost of the liquid crystal display devices is brought down as their market matures, and there is a demand for reduction of the areas of chips of the drain drivers as well as the reduction of the border areas around a display area.

As liquid crystal panels used for a monitor spread as a large-screen display device superseding a cathode ray tube, there has been a demand for liquid crystal display devices capable of higher resolution and a larger number of gray scales. It is essential that the liquid crystal panels for a monitor can display 256 gray scales, while liquid crystal panels for notebook personal computers displayed 64 gray scales.

As for resolution also, the number of pixels in the liquid crystal monitor panel is changing from the XGA (extended video graphics array) specification to the SXGA (super XGA) specification and the UXGA (ultra XGA) specification and consequently, electrical loads on the liquid crystal panels tends to increase, and a time for writing in gray-scale voltages corresponding to a line in the liquid crystal panel is made shorter because a display speed of one picture is fixed. At the present time, the larger the screen size and the higher the resolution, the higher the gray-scale voltages, to retain the brightness equal to that by the conventional liquid crystal panel.

In the above situation, the increases in resolution, the number of gray-scales and operating voltages lead to the increases in IC chip size and consequently, the cost is increased.

A conventional decoder system of a so-called tournament type requires the same number of decoder circuits as that of gray scales, which is a great factor in the increase in chip size caused by the increase in the number of gray-scales, and this makes it difficult to reduce the border areas around a display area. The term tournament type comes from an analogy that exists between selection of one of many gray-scale voltages and a tournament in which many contestants compete for championship in series of elimination contests.

FIG. 25 is a circuit of a low-voltage circuit portion of a drain driver employing the conventional tournament type decoder system. The dot-polarity inversion method requires a high-voltage circuit portion of the drain driver for forming a pair with the low-voltage circuit portion. The high-voltage circuit portion is identical in configuration with the low-voltage circuit portion in FIG. 25, except that NMOS transistors serving as switching elements in FIG. 25 are interchanged with PMOS transistors, and its explanation is omitted.

In the low-voltage circuit portion in FIG. 25, three circuits CKTB, CKTC and CKTD identical with a circuit CKTA connected to a terminal A as shown in FIG. 25 are connected to terminals B, C and D, respectively and the circuits CKTA, CKTB, CKTC and CKTD are supplied with four groups of gray-scale voltages V000 to V063, gray-scale voltages V064 to V127, gray-scale voltages V128 to V191 and V192 to V255, respectively.

All the tournament type decoders CKTA, CKTB, CKTC and CKTD connected to the terminals A, B, C and D, respectively, are identical in configuration, and therefore the following explains only the tournament type decoder CKTA connected to the terminal A and supplied with the gray-scale voltages V000 to V063.

Input terminals D0N, D0P, D1N, D1P, . . . D6N and D6P of the tournament type decoder CKTA are supplied with a display data, and V00, V01, V02, . . . and V63 are 64 gray-scale voltages. Back gates of the NMOS transistors are connected to ground (GND). An output terminal YB outputs drain line drive voltages of negative polarity (drain line drive voltages of a low-voltage side).

FIG. 26 is a schematic of the overall configuration of the tournament type decoder. V00 to V255 are gray-scale voltages, and each of the decoders 0 to 255 comprises eight MOS transistors denoted by ○ serving as switching elements. Vn denotes an output.

This configuration requires 256 decoders each formed by eight MOS transistors connected in series, and requires 256 wiring lines (gray-scale voltage lines) for supplying the gray-scale voltages to the 256 decoders from a voltage divider (a resistive-ladder network) of a gray-scale voltage generator circuit.

An increase in electrical load of the liquid crystal panel caused by increasing resolution and the screen size of the liquid crystal panel causes insufficient writing-in of gray-scale voltages and degrades the quality of a display image.

FIG. 27 is an illustration of a relationship between gray-scale voltages and writing-in time. Here the writing-in time is plotted as abscissas and the gray-scale voltages as ordinates. The broken curve shows a relationship between gray-scale voltages and writing-in time for a conventional SVGA (Super-Video Graphics Array) 64-gray-scale liquid crystal panel of a nominal screen size of about 14 inches, for example, and the full curve shows a relationship between gray-scale voltages and writing-in time for a large-screen, high-resolution XGA or SXGA 256-gray-scale liquid crystal panel of a nominal screen size of about 18 inches or more, for example.

If the liquid crystal panel is configured so as to increase the resolution, an electrical load of the liquid crystal panel is increased and consequently, time constant of writing-in voltages is increased. Further, the period of one picture frame is fixed even if the number of pixels is increased and consequently, the time usable for writing-in of gray-scale voltages is reduced relatively, and if the number of bits representing display data is increased by increasing the number of gray-scale steps, resistances of the decoders are increased and time constant of writing-in voltages is increased, resulting in insufficient writing-in of gray-scale voltages.

It is an object of the present invention to provide a high-resolution multi-gray scale liquid crystal display device having reduced border areas around a display area by reducing the number of decoders and the number of wiring lines so as to suppress an increase in chip size.

It is another object of the present invention to provide a liquid crystal display device capable of displaying a high-quality image by suppressing an increase in on-resistances of decoders.

The above objects are realized by generating two gray-scale voltage by using an output amplifier (sometimes referred to merely as an amplifier), and are realized by reducing delay of gray-scale voltages within a chip suppressing an increase in on-resistances of decoders caused by an increase of gray-scale steps.

The following are representative configurations of the present invention for achieving the above objects:

To accomplish the above objects, in accordance with an embodiment of the present invention, there is provided a liquid crystal display device including a liquid crystal panel having a plurality of pixels and a video signal line driver circuit for supplying a video signal voltage to each of the plurality of pixels via a corresponding one of a plurality of video lines in accordance with a display data comprising P bits, the video signal line driver circuit comprising: a power supply circuit for supplying Q different gray-scale voltages; a plurality of selector circuits corresponding to the plurality of video lines, each of the plurality of selector circuits for outputting one of first and second pairs of voltages in accordance with the display data, the first pair comprising two voltages equal to a same one selected from among the Q different gray-scale voltages, the second pair comprising two different voltages selected from among the Q different gray-scale voltages; and a plurality of amplifiers corresponding to the plurality of video lines, each of the plurality of amplifiers for outputting the video signal voltage to a corresponding one of the plurality of video lines based upon one of the first and second pairs of voltages or a voltage intermediate between the second pair of voltages and produced from the second pair of voltages in the amplifiers.

To accomplish the above objects, in accordance with another embodiment of the present invention, there is provided a liquid crystal display device including a liquid crystal panel having a plurality of pixels and a video signal line driver circuit for supplying a video signal voltage to each of the plurality of pixels via a corresponding one of a plurality of video lines in accordance with a display data comprising P bits, the video signal line driver circuit comprising: a power supply. circuit for supplying Q different gray-scale voltages; a plurality of selector circuits corresponding to the plurality: of video lines, each of the plurality of selector circuits for outputting a plurality of voltages selected from among the Q different gray-scale voltages in accordance with the display data; and a plurality of amplifiers corresponding to the plurality of video lines, each of the plurality of amplifiers for outputting the video signal voltage to a corresponding one of the plurality of video lines based upon one of the plurality of voltages or a voltage different from the plurality of voltages and produced from the plurality of voltages in the amplifiers, in accordance with the display data.

To accomplish the above objects, in accordance with another embodiment of the present invention, there is provided a liquid crystal display device including a liquid crystal panel having a plurality of pixels and a video signal line driver circuit for supplying a video signal voltage to each of the plurality of pixels via a corresponding one of a plurality of video lines in accordance with a display data comprising P bits, the video signal line driver circuit comprising: a power supply circuit for supplying Q different gray-scale voltages; a plurality of selector circuits corresponding to the plurality of video lines, each of the plurality of selector circuits for outputting one of first and second pairs of voltages in accordance with the display data, the first pair comprising two voltages equal to a same one selected from among the Q different gray-scale voltages, the second pair comprising two different voltages selected from among the Q different gray-scale voltages; and a plurality of amplifiers corresponding to the plurality of video lines, each of the plurality of amplifiers for outputting the video signal voltage to a corresponding one of the plurality of video lines by current-amplifying the first pair of voltages or current-amplifying a voltage intermediate between the second pair of voltages and produced from the second pair of voltages in the amplifiers, in accordance with the display data.

With the above configurations, output voltages of M gray-scale steps are generated by using (M+1)/2 input voltages if the number M is odd, or using (M/2+1) input voltages if the number M is even, and consequently, the circuit size of the drain drivers is reduced so as to reduce the area of the chip, output voltages matched with γ characteristics of the liquid crystal are obtained, the cost of the TFT liquid crystal panel is brought down and the border areas around the display area in the liquid crystal display device are reduced.

The present invention is not limited to the above configurations or embodiments described subsequently, but various changes and modifications can be made to those without departing from the nature and spirit of the invention.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiments of the present invention will be explained in detail by reference to the drawings.

Figure 1:
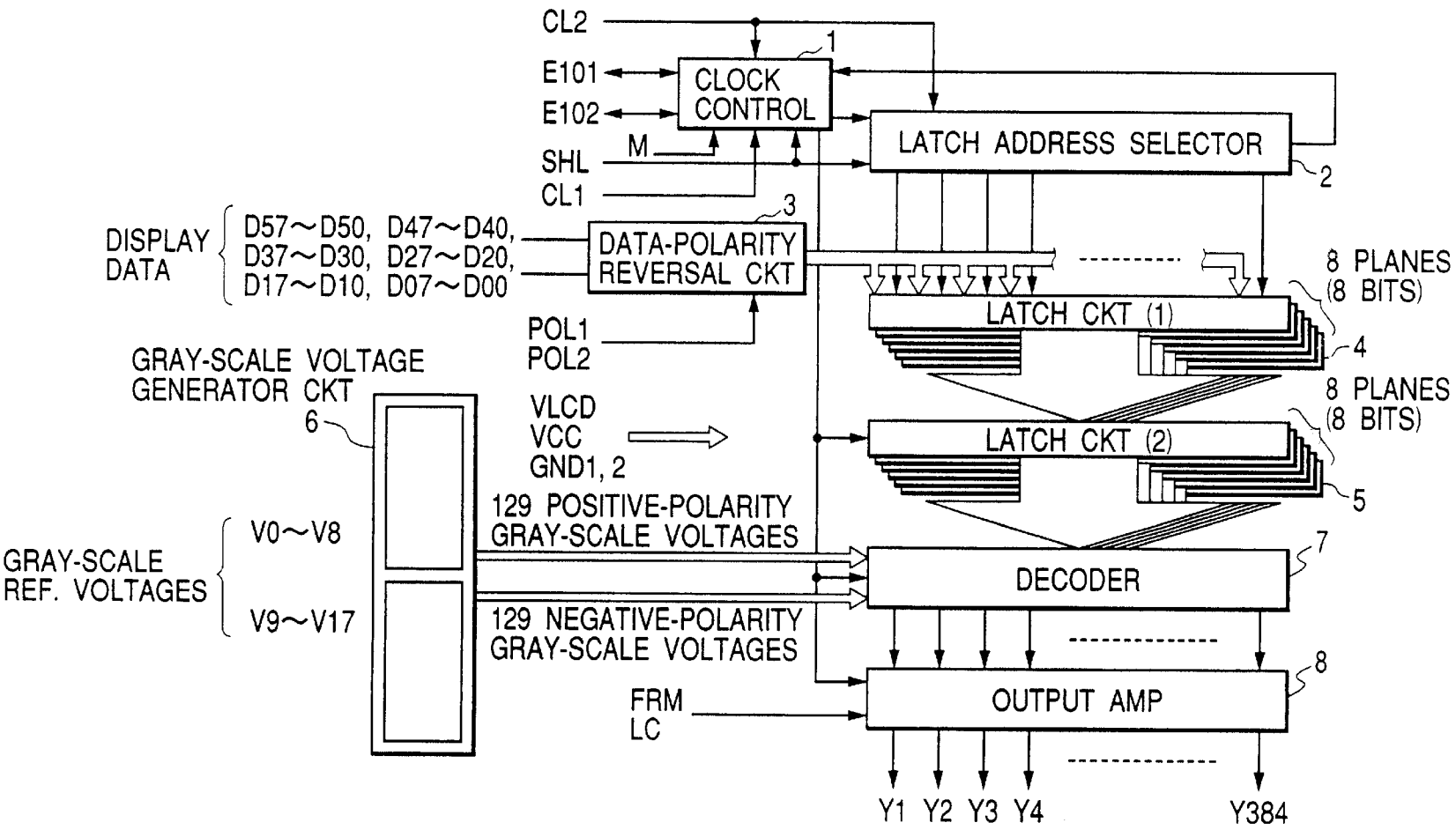
FIG. 1 is a block diagram illustrating a configuration of a drain driver of a TFT active matrix type liquid crystal display device of a first embodiment of the present invention.

FIG. 1 is a block diagram illustrating a configuration of a drain driver of a TFT active matrix type liquid crystal display device (hereinafter referred to merely as a TFT liquid crystal display device) of a first embodiment of the present invention.

We shall consider a drain driver which displays 256 gray-scale steps (M=256) in accordance with 8-bit display data (a=8) and has 384 outputs as an example.

The drain driver comprises a clock control circuit 1, a latch address selector 2, a data-polarity reversal circuit 3, a latch circuit (1) 4, a latch circuit (2) 5, a gray-scale voltage generator circuit 6, a decoder (a gray-scale voltage selector circuit) 7, and an output amplifier 8.

As clocks and control signals, there are a line clock CL1, a pixel clock CL2, a frame recognizing signal FRM, a control signal LC for an internal line counter circuit, enable start pulses EIO1, EIO2, a control signal M for AC driving, a signal SHL for controlling a shift direction, and control signals POL1, POL2 for polarity reversal of data. As operating voltages, there are a supply voltage VLCD for high-voltage circuits, a supply voltage VCC for low-voltage circuits, grounds GND1, GND2 for the low- and high-voltage circuits, respectively.

Each of the latch circuit (1) 4 and the latch circuit (2) 5 are formed of 384 eight-bit (256 gray-scales) circuits, the decoder 7 outputs 384 pieces of decoded data, and the output amplifier 8 outputs 384 pieces of display data Y1 to Y384.

This embodiment employs a positive-negative polarity-asymmetric voltage drive system in which 129 gray-scale voltages of positive polarity and 129 gray-scale voltages of negative polarity are produced separately within chips of the gray-scale voltage generator circuit 6 based upon gray-scale reference voltages V0 to V8 and V9 to V17, respectively, and are supplied to the decoder 7. The reason why 129 (=128+1) gray-scale voltages of both positive and negative polarities are produced is that, in this embodiment, two gray-scale voltages are synthesized by the output amplifier 8 and therefore the maximum gray-scale voltage must be synthesized by the output amplifier 8 using another voltage higher than the maximum gray-scale voltage such that 256 (gray-scales)/2+1=128+1=129.

Display data (D57-D50, D47-D40, D37-D30, D27-D20, D17-D10 and D07-D00) are supplied to the latch circuit (1) 4 via the data-polarity reversal circuit 3, and are latched by the latch address selector 2 controlled by the pixel clock CL2.

The display data held by the latch circuit (1) 4 are supplied via the latch circuit (2) 5 to the decoder 7 by the line clock CL1 synchronized with each scanning line of the liquid crystal panel. Hereinafter the decoder may also be referred to as the decoder circuit.

The decoder 7 selects the gray-scale voltages produced by the gray-scale voltage generator circuit 6 in accordance with input display data and supplies them to the output amplifier 8. The output amplifier 8 produces the drain driver outputs Y1 to Y384 by current-amplifying the input gray-scale voltages and supplies them to video signal lines (drain lines) of the liquid crystal panel to write them in pixels.

Figure 2:
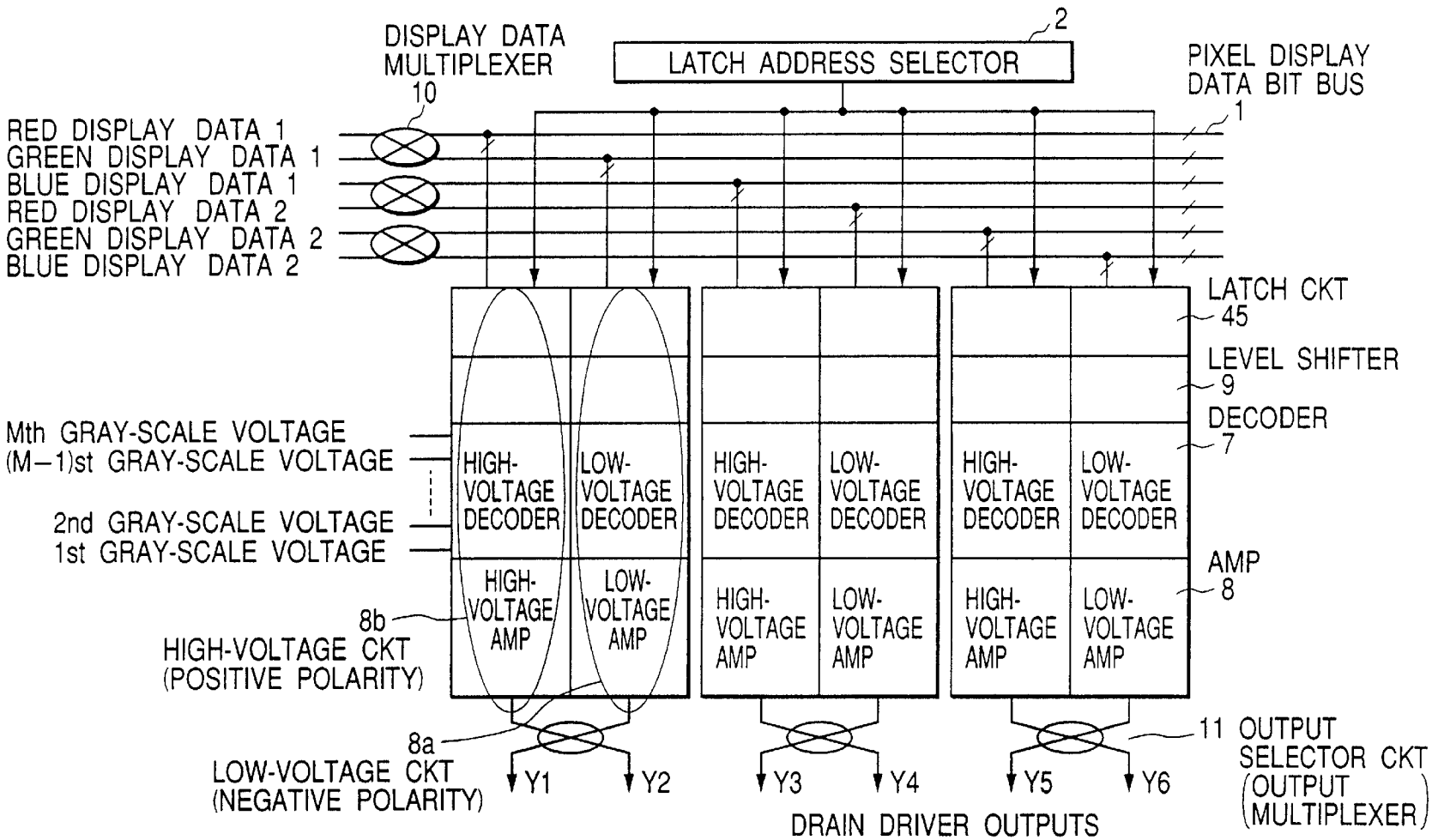
FIG. 2 is an illustration of an internal circuit of an example of the drain driver of the first embodiment of the present invention.
Figure 3:
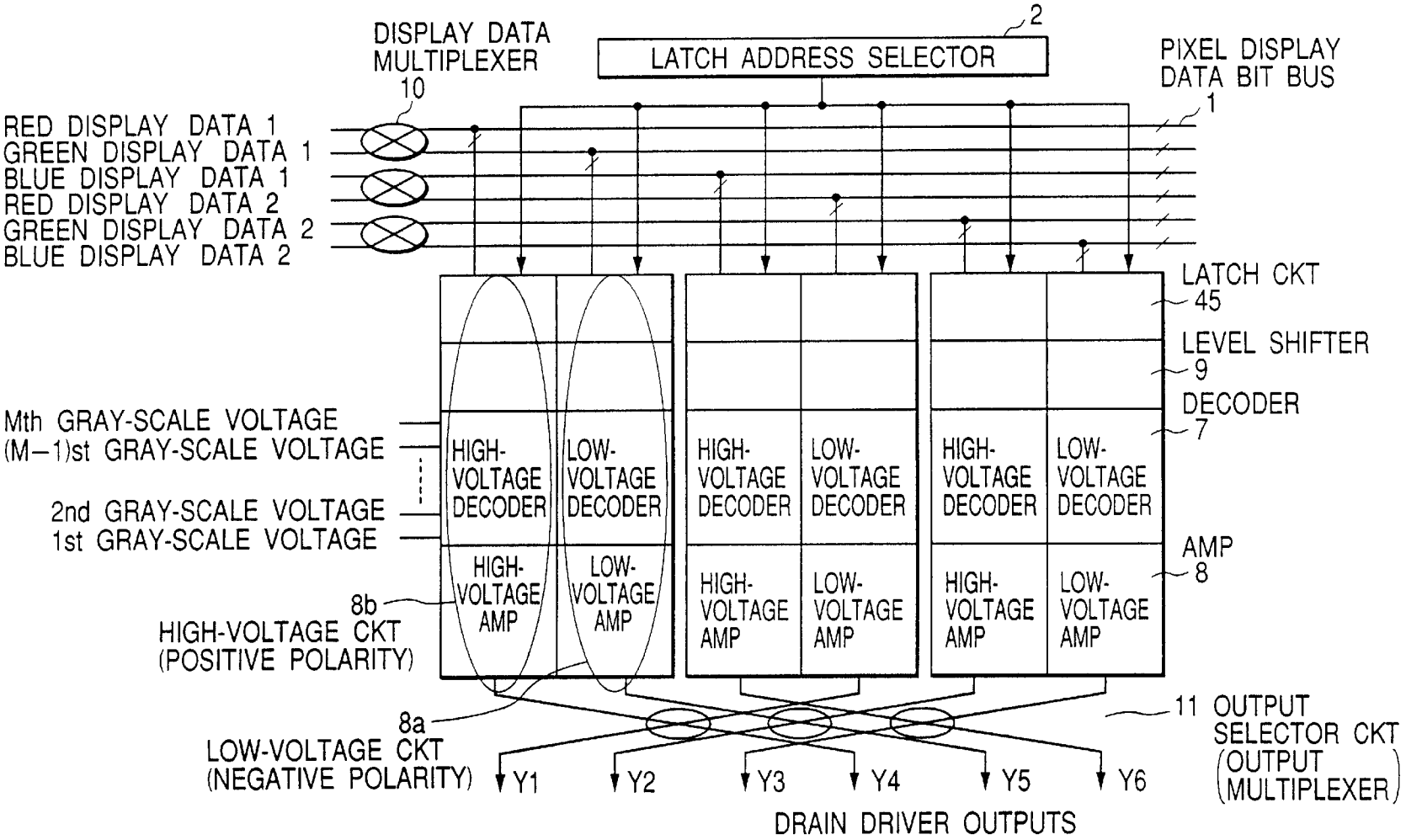
FIG. 3 is an illustration of an internal circuit of another example of the drain driver of the first embodiment of the present invention.

FIGS. 2 and 3 are illustrations of internal circuits of two examples of the drain driver of the first embodiment of the present invention, respectively, and the same reference numerals as utilized in FIG. 1 designate parts functionally similar in FIGS. 2 and 3. Reference numeral 45 denote combinations of the latch circuit (1) 4 and the latch circuit (2) 5 in FIG. 1, reference numeral 8*a* are low-voltage circuits, 8*b* are high-voltage circuits, 9 are level shifters, 10 are display data multiplexers, and 11 are output selector circuits (output multiplexers).

As shown in FIGS. 2 and 3, the dot-polarity inversion drive method uses an alternate arrangement of output terminals supplied with voltages of negative polarity (low voltages) and output terminals supplied with voltages of positive polarity (high voltages) and reverses the polarities of the voltages periodically, and thereby the numbers of the low-voltage circuits 8*a* and the high-voltage circuits 8*b*, respectively, are reduced to half the number of the output terminals so as to reduce the chip size.

For performing the dot-polarity inversion, the display data multiplexers (MPX) 10 and the output multiplexers 11 are provided before and behind the low-voltage circuits 8*a* and the high-voltage circuits 8*b*, respectively, so as to alternately input display data to one of a pair of a low-voltage circuit 8*a* and a high-voltage circuit 8*b*.

The latch circuits 45 and the level shifters 9 can use the identical circuits for both the low-voltage and high-voltage circuits. The decoders 7 use two separate circuits specialized for the low-voltage circuits 8*a* and the high-voltage circuits 8*b*, respectively, so as to reduce the chip sizes.

The decoders 7 have the feature that they can output two gray-scale voltages of one gray-scale voltage value selected from among 258 gray-scale voltages supplied from the gray-scale voltage generator circuit 6 of FIG. 1 or output two different gray-scale voltages selected from among the 258 gray-scale voltages.

Figure 4:
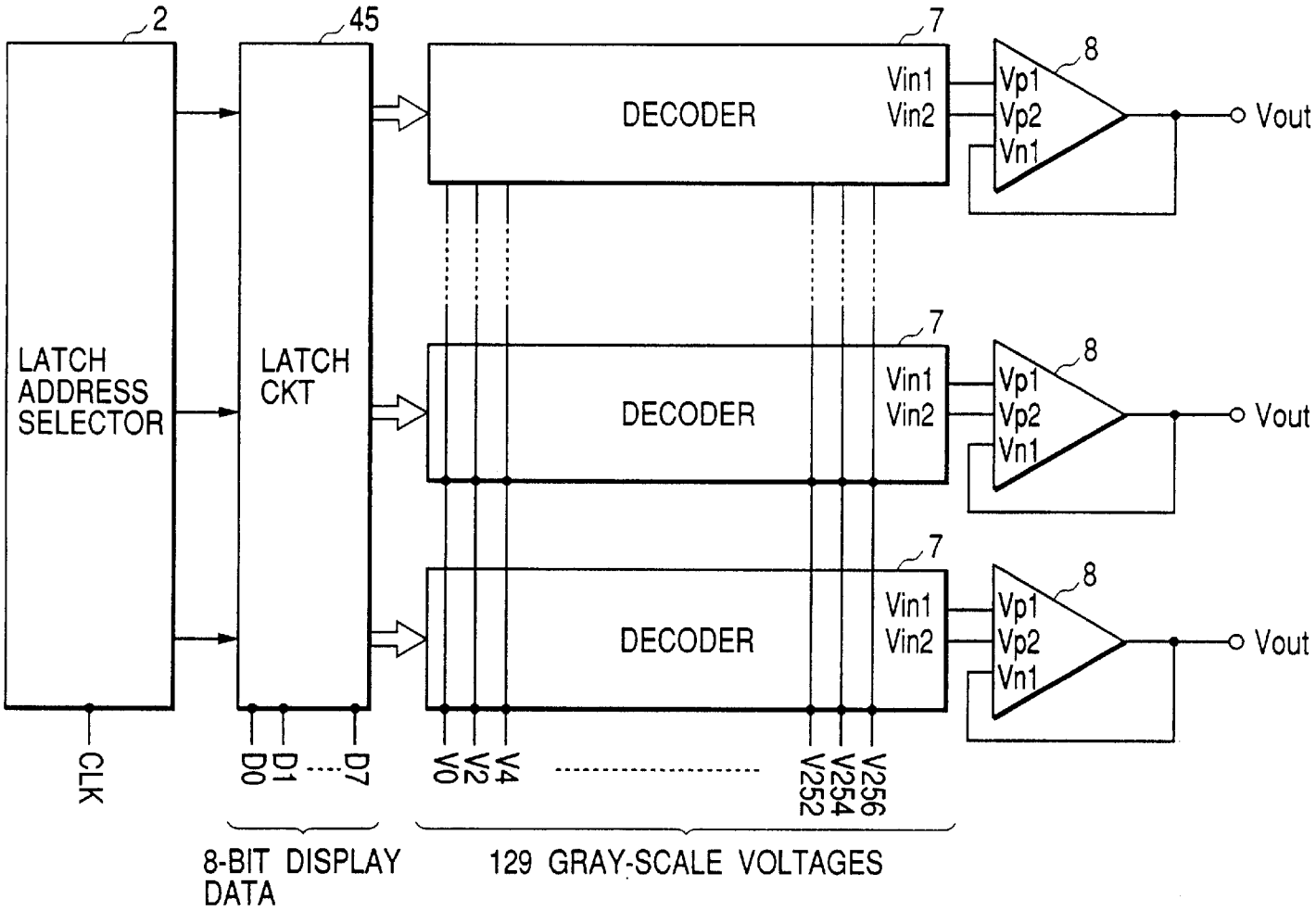
FIG. 4 is a block diagram for explaining the operation of the drain drivers of FIGS. 2 and 3.

FIG. 4 is a block diagram for explaining the operation of the drain drivers of this embodiment shown in FIGS. 2 and 3. Each of the decoders 7 is supplied with voltages corresponding to alternate gray-scales among all the gray-scales to be displayed. 8-bit and 6-bit display data correspond to 256 and 64 gray-scales, respectively. We shall consider 256 gray-scale display corresponding to 8-bit display data.

As for the number of gray-scale voltages to be supplied to each of the decoders 7, if the total number M of gray-scales to be displayed is odd, the gray-scale voltages to be supplied are alternate gray-scale voltages, but if the total number M of gray-scales to be displayed is even (usually even), an additional maximum gray-scale voltage is necessary in addition to the alternate gray-scale voltages. That is to say, if the total number M of gray-scales to be displayed is odd, the number of the gray-scale voltages to be supplied is (M+1)/2 comprising V0, V2, V4, . . . V(M−3) and V(M−1), and if the total number M of gray-scales to be displayed is even, the number of the gray-scale voltages to be supplied is (M/2+1) comprising V0, V2, V4, . . . V(M−4), V(M−2) and V(M−1).

Each of the decoders 7 has two outputs Vin1 and Vin2, and supplies these outputs to two positive terminals Vp1 and Vp2 of the output amplifier 8, respectively, and the amplifier 8 outputs Vout in accordance with these inputs.

Figure 5A:
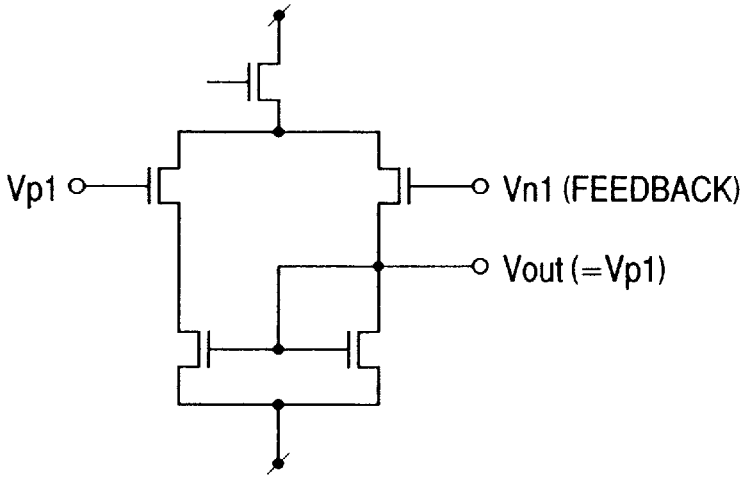
FIG. 5A PRIOR ART
FIG. 5A is a circuit of a prior art output amplifier for a drain driver.
Figure 5B:
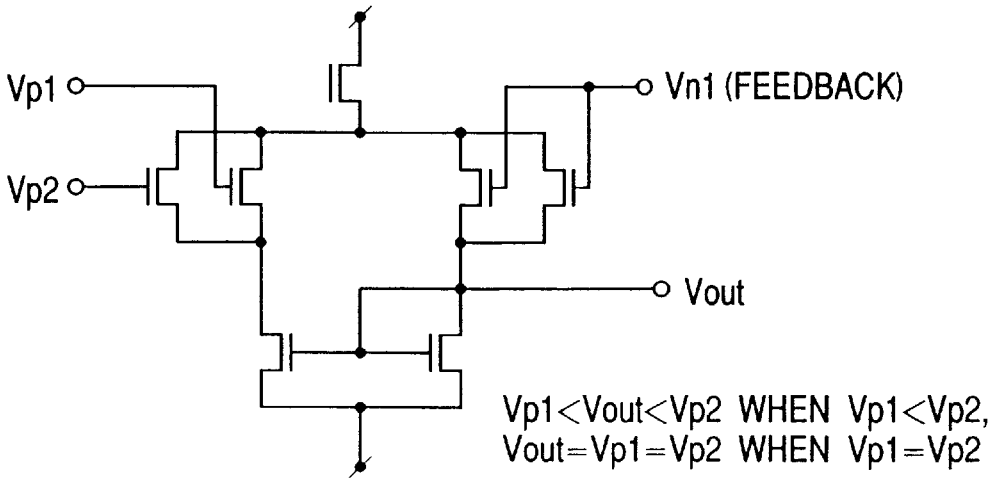
FIG. 5B is a concrete circuit of an output amplifier of the drain driver of the first embodiment of the present invention.

FIGS. 5A and 5B are illustrations of concrete output amplifiers, FIG. 5A illustrates a prior art output amplifier, and FIG. 5B illustrates an output amplifier used for the first embodiment of the present invention. The output amplifier of FIG. 5A produces an output Vout by current-amplifying an input Vp1, that is, produces one output for one input.

On the other hand, as shown in FIG. 5B, the output amplifier in this embodiment is configured such that an input-side MOS transistor is divided into two MOS transistors to produce an output Vout for two inputs Vp1 and Vp2. If the two inputs Vp1 and Vp2 are the same gray-scale voltage, V2, for example, the output Vout becomes V2, but if the two inputs Vp1 and Vp2 are two gray-scale voltages close to each other, V0 and V2, for example, the output Vout becomes a voltage V1 intermediate between V0 and V2, synthesized from the two inputs Vp1 and Vp2.

Figure 6:
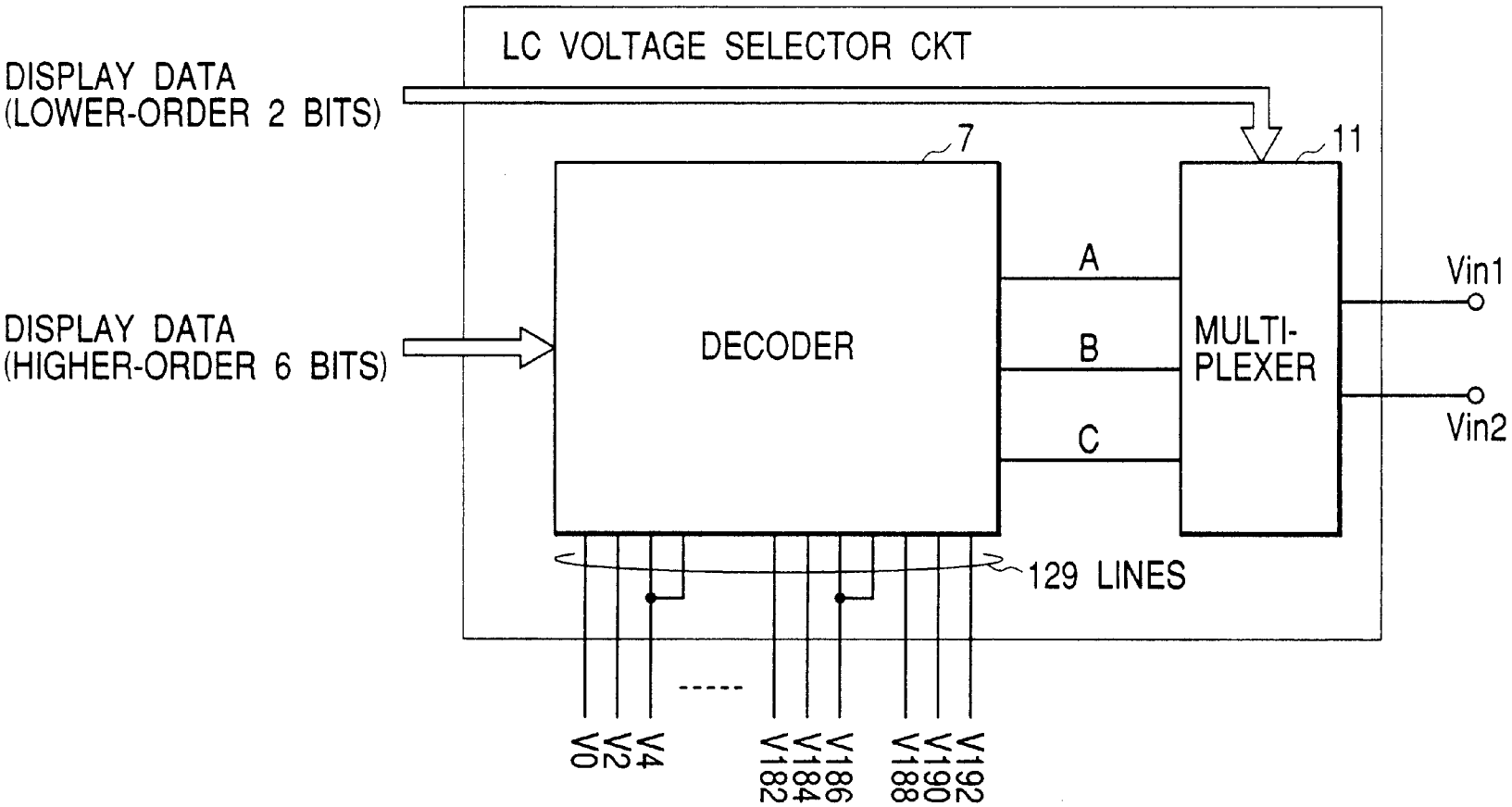
FIG. 6 is a block diagram for explaining an internal configuration of a gray-scale voltage selector circuit of the first embodiment of the present invention.

FIG. 6 is a block diagram for explaining an internal configuration of a gray-scale voltage selector circuit of the first embodiment of the present invention, and the gray-scale voltage selector circuit comprises the decoder 7 and the multiplexer 11. The decoder 7 selects three successive gray-scale voltages A, B and C from among the 129 gray-scale voltages supplied by the gray-scale voltage generator circuit 6, in accordance with higher-order 6 bits of a display data, and supplies them to the multiplexer 11. The multiplexer 11 selects one or two from among the three gray-scale voltages A, B and C in accordance with lower-order 2 bits of the display data and outputs them as Vin1 and Vin2.

Figure 7:
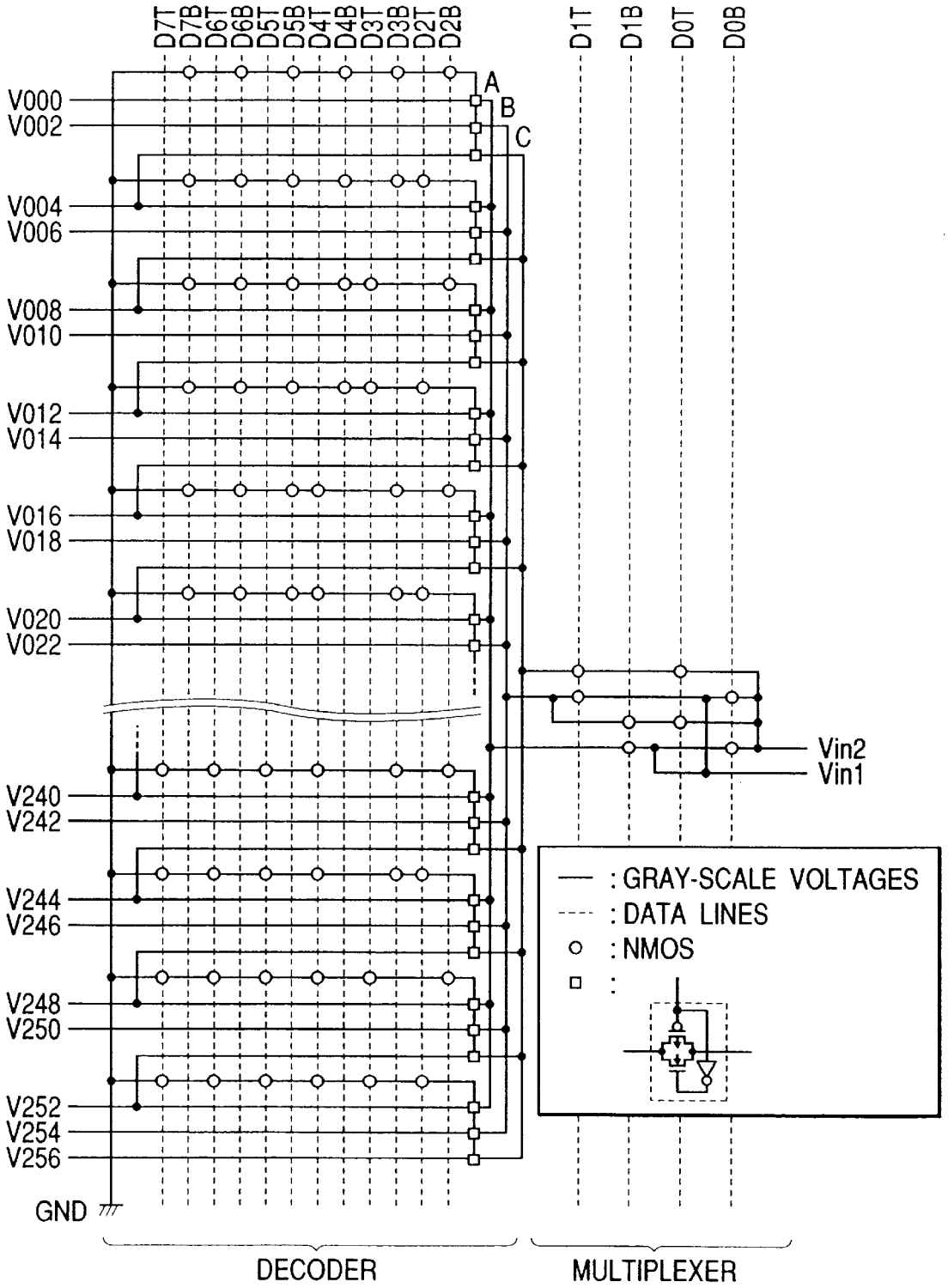
FIG. 7 is a concrete circuit of the gray-scale voltage selector circuit of FIG. 6.

FIG. 7 illustrates a concrete circuit of the gray-scale voltage selector circuit of FIG. 6. The circuit of FIG. 7 is a liquid crystal voltage selector circuit used for the low-voltage (negative-polarity) circuit portion, and ○ in FIG. 7 denotes NMOS transistors.

A liquid crystal voltage selector circuit used for the high-voltage (positive-polarity) circuit portion is obtained by interchanging B's and T's in the input data D2B, D2T, . . . , D7B, D7T, replacing all the NMOS transistors with PMOS transistors, and making the source potentials of the MOS transistors in the decoder block vss, in FIG. 7.

The operation of the circuit of FIG. 7 is shown in Table I. Table I and Tables II to IV discussed subsequently are placed together at the end of this section "DETAILED DESCRIPTION OF THE PREFERRED EMBODIMENTS."

In Table I, "GRAY-SCALE VOLTAGES" means gray-scale voltages corresponding to display data, "DECODER INPUT" means gray-scale voltages supplied to the decoders in this embodiment, "DIGITAL INPUT BITS" are 8-bit display data for 256 gray-scales supplied to the drain driver, "MULTIPLEXER INPUT VOLTAGES" are three successive gray-scale voltages determined by higher-order 6 bits of the "DIGITAL INPUT BITS" and supplied to lines A, B and C, respectively, indicated in FIGS. 6 and 7, and "MULTIPLEXER-SELECTED VOLTAGES" are gray-scale voltages supplied as Vin1 and Vin2 in accordance with the lower-order 2 bits of the "DIGITAL INPUT BITS."

Figure 20A:
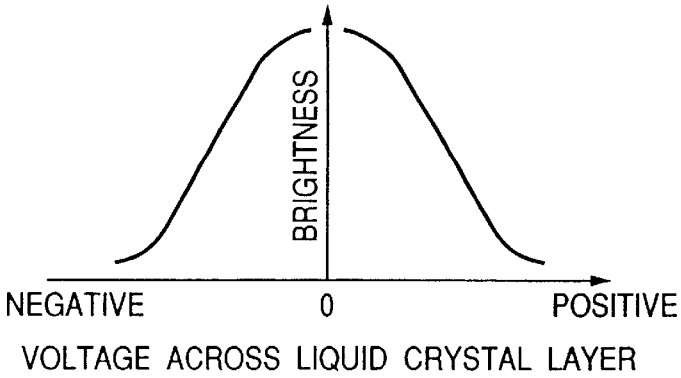
FIG. 20A is a graph showing a relationship between brightness and voltages applied across the liquid crystal layer.
Figure 20B:
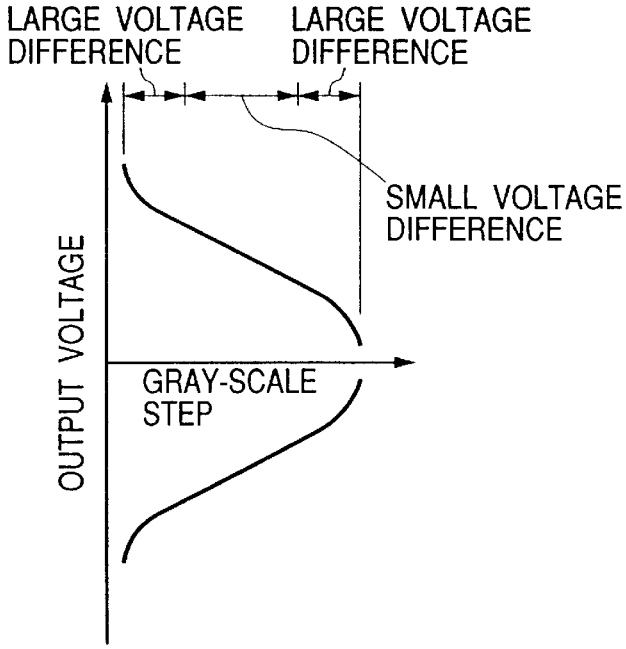
FIG. 20B is a graph showing a relationship between gray-scale steps and drain driver output voltages.
Figure 20C:
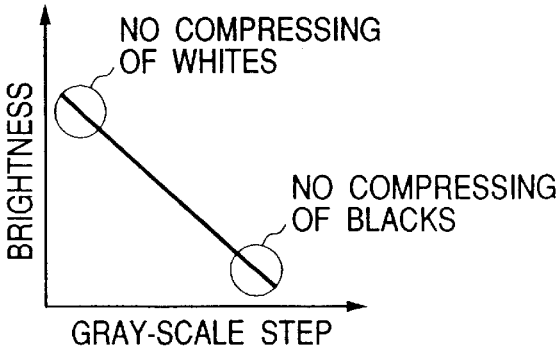
FIG. 20C is a graph showing a relationship between brightness and gray-scale steps.

According to this embodiment, M gray-scale voltages are produced from a number (M+1)/2 of input voltages when the total number M of gray-scales to be displayed is odd, or from a number (M/2+1) of input voltages when the total number M of gray-scales to be displayed is even, and consequently, the area of the IC chips is reduced, output voltages matched with γ characteristics of the liquid crystal discussed subsequently in connection with FIGS. 20A–20C are obtained without an increase of the IC chips, the cost of the liquid crystal panel is brought down and the border areas around the display area of the liquid crystal display device are reduced.

Figure 25:
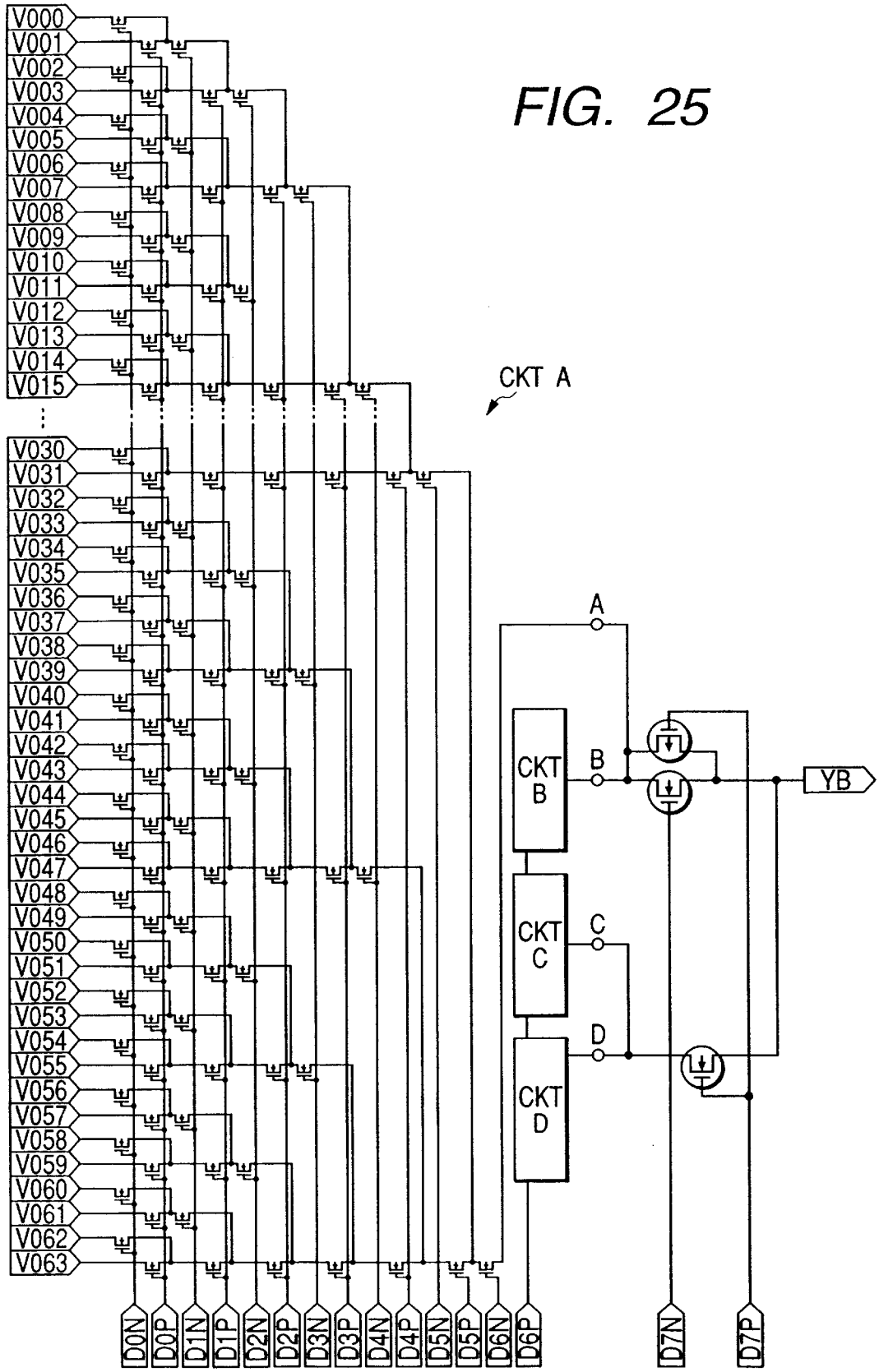
FIG. 25 is a circuit of a low-voltage circuit portion of a drain driver employing a conventional tournament type decoder system.
Figure 26:
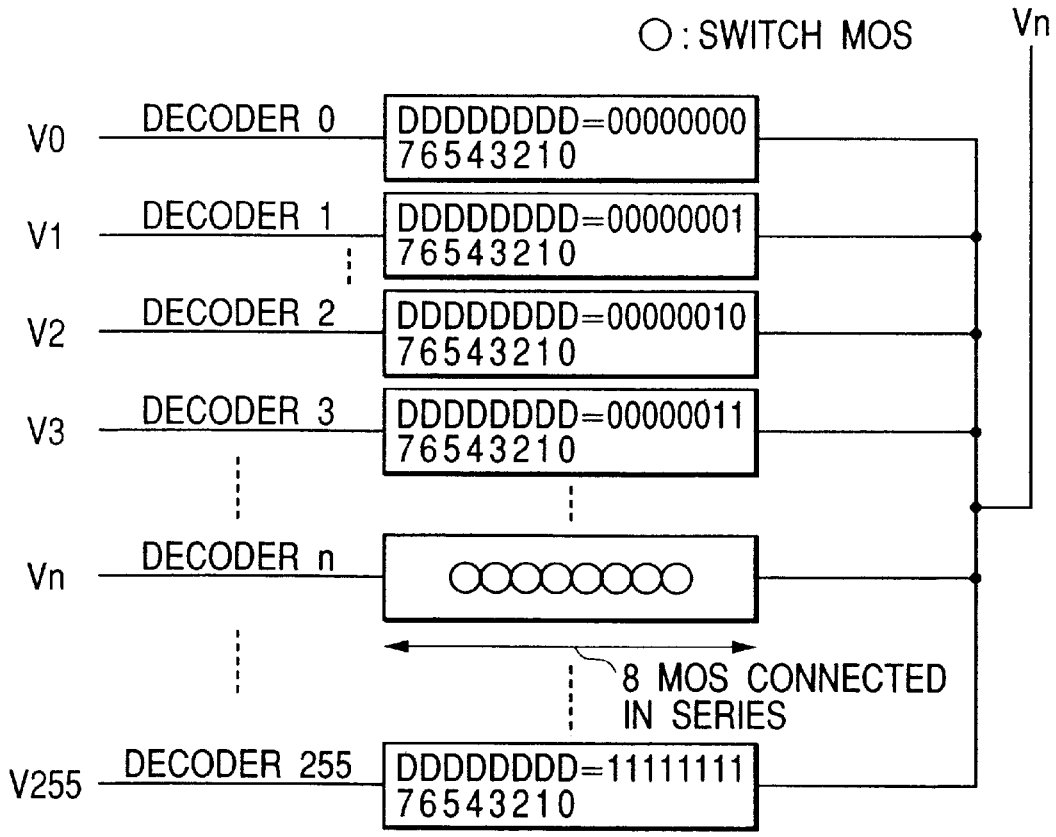
FIG. 26 is a schematic of the overall configuration of the tournament type decoder.

In the present embodiment, the circuit size of is greatly reduced compared with the circuit employing the decoder of the tournament type explained in connection with FIG. 25, and the number of the gray-scale voltage lines is reduced from 256 to 192.

Figure 8:
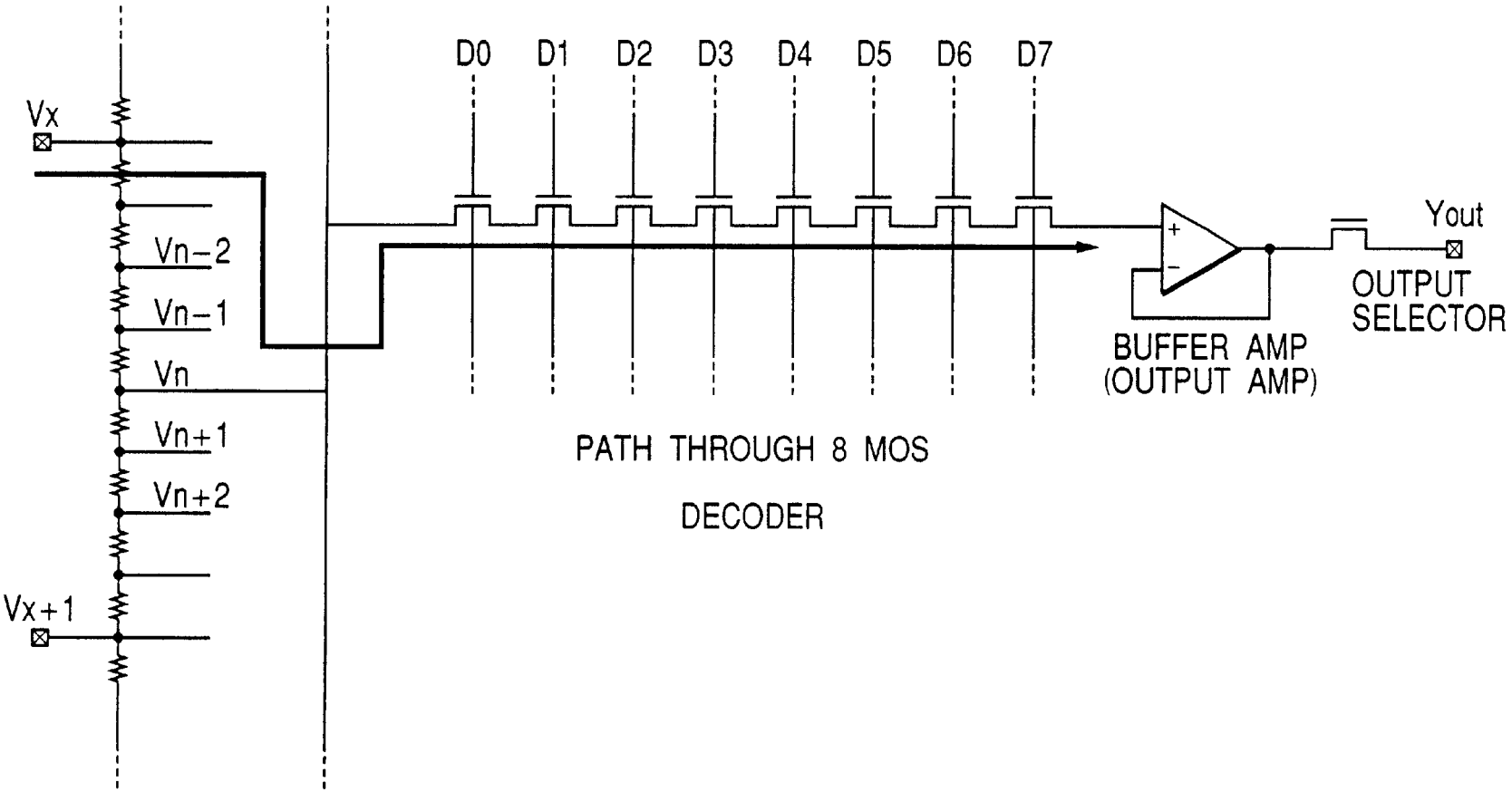
FIG. 8 PRIOR ART
FIG. 8 is an illustration of an output path in the case in which a conventional tournament type decoder is used.
Figure 9:
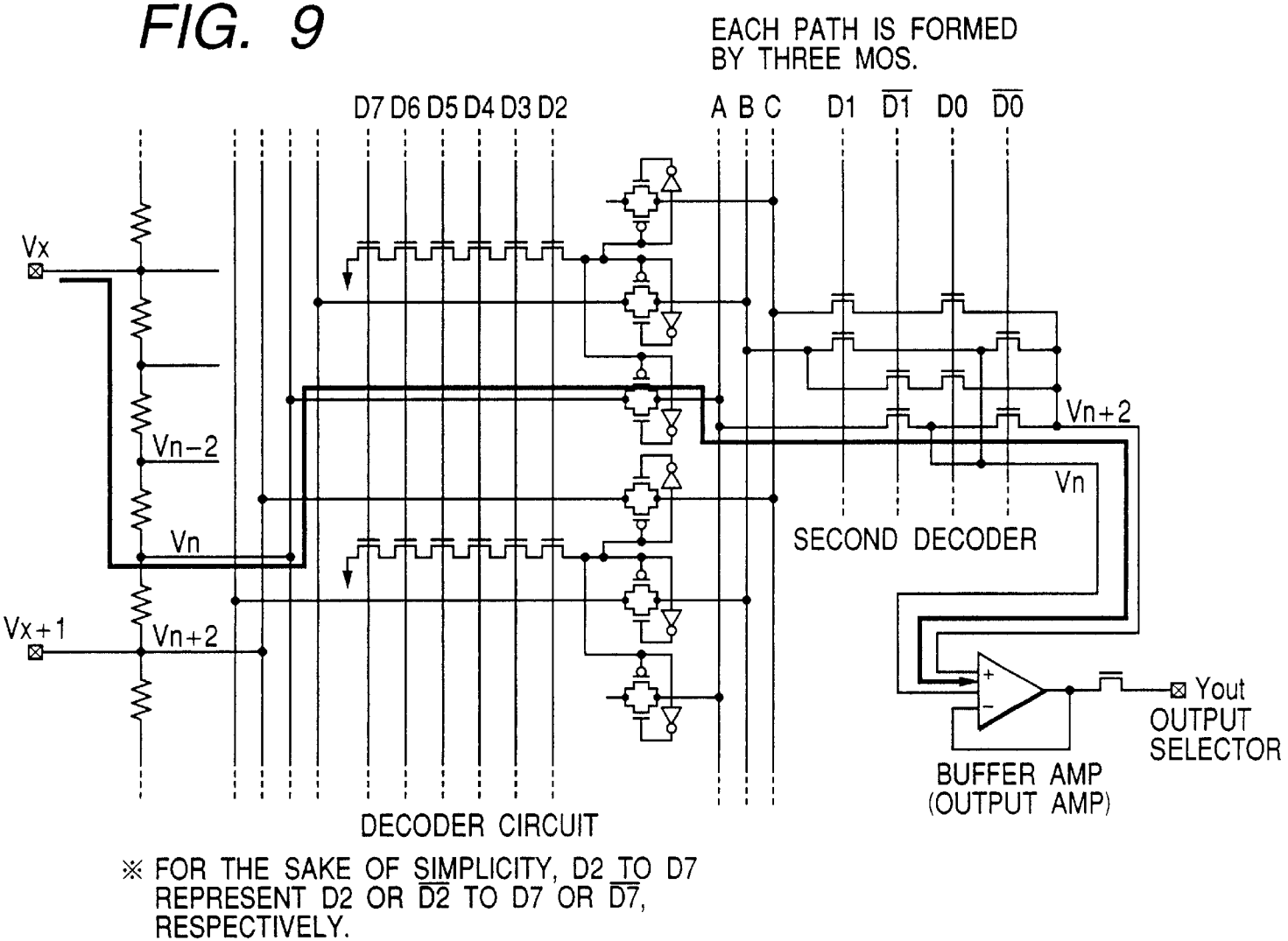
FIG. 9 is an illustration of an output path in a decoder of the present invention.

FIG. 8 is an illustration of an output path in the case in which a conventional tournament type decoder is used, and FIG. 9 is an illustration of an output path in the decoder of the present embodiment. In the conventional decoder of FIG. 8, a selected gray-scale voltage is outputted to the output amplifier (a buffer amplifier in FIG. 8) though eight MOS transistors connected in series.

Figure 27:
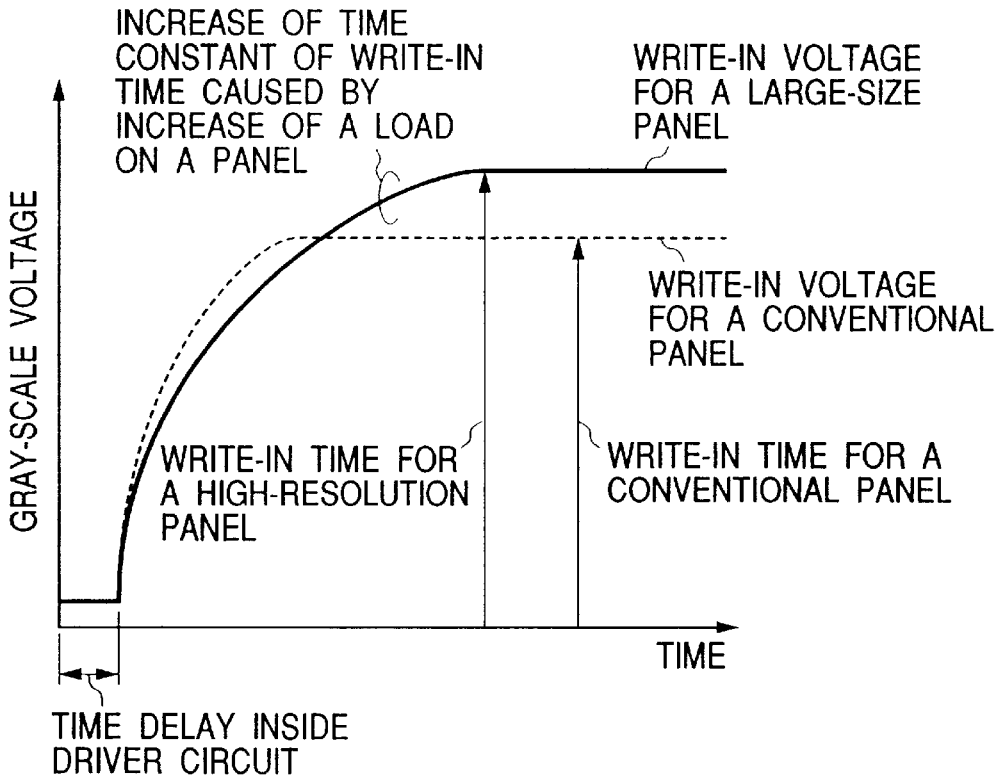
FIG. 27 is a graph showing a relationship between gray-scale voltages and writing-in time.

On the other hand, in the decoder of the present invention shown in FIG. 9, a selected gray-scale voltage is inputted to the output amplifier though three MOS transistors connected in series, and consequently, the total on-resistance of the MOS transistors forming the decoder is greatly reduced compared with that of FIG. 8, and time delay within the drivers explained in connection with FIG. 27 is reduced such that insufficiency in write-in time of gray-scale voltages is suppressed.

Next, a second embodiment will be explained which is capable of suppressing an increase in the number of decoders for display data with an increase of the number of gray-scale steps and an increase in operating voltages, thereby suppressing an increase in IC chip size and realizing more inexpensive multi-gray scale drain drivers, and consequently, making possible reduction of the border areas around a display area and the cost of the liquid crystal display device.

Figure 10:
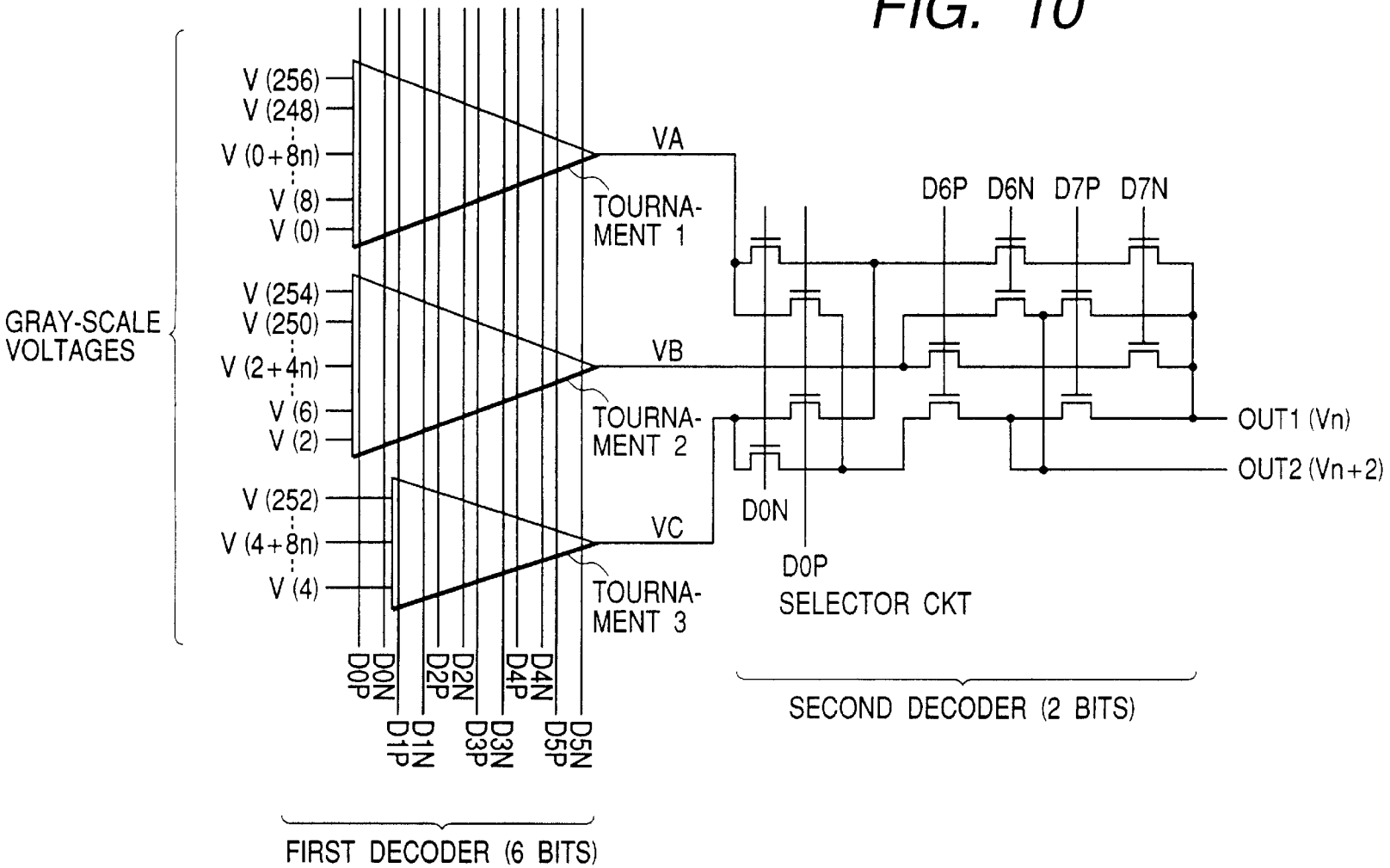
FIG. 10 is a schematic illustration of a configuration of a drain driver of a second embodiment of the present invention.

FIG. 10 is a schematic of a configuration of a drain driver for realizing a multi-gray scale display using decoders. The present embodiment assumes that the above-explained two-input output amplifier is employed, and input 8-bit display data is divided into two groups of 6 bits and 2 bits, respectively, and decoders of the tournament type are used for decoding the 6-bit display data.

In FIG. 10, input gray-scale voltages represented by 6 bits (D0P, D0N, D1P, D1N, D2P, D2N, D3P, D3N, D4P, D4N, D5P, D5N), of 8-bit display data are divided into three blocks A, B and C. A tournament 1 associated with a decoder A decodes gray-scale voltages V0, V8, . . . , V(0+8n), . . . , V248 and V256, a tournament 2 associated with a decoder B decodes gray-scale voltages V2, V6, . . . , V(2+4n), . . . , V250 and V254, and a tournament 3 associated with a decoder C decodes gray-scale voltages V4, V12, . . . , V(4+8n), . . . , V(244) and V(252). The tournaments 1, 2 and 3 form a first decoder.

Outputs VA, VB and VC from the first decoder are inputted into a second decoder controlled by 2-bit data (D6P, D6N, D7P and D7N) via a selector circuit switched by data D0N and D0P, to provide two outputs OUT1 (Vn) and OUT2 (Vn+2). The selector circuit selects one output from each of the three outputs VA, VB and VC from the three blocks, respectively, and supplies them to the second decoder, to provide the two outputs OUT1 (Vn) and OUT2 (Vn+2). The two outputs OUT1 (Vn) and OUT2 (Vn+2) are inputted into the two-input output amplifier 8 explained in the first embodiment.

Figure 11:
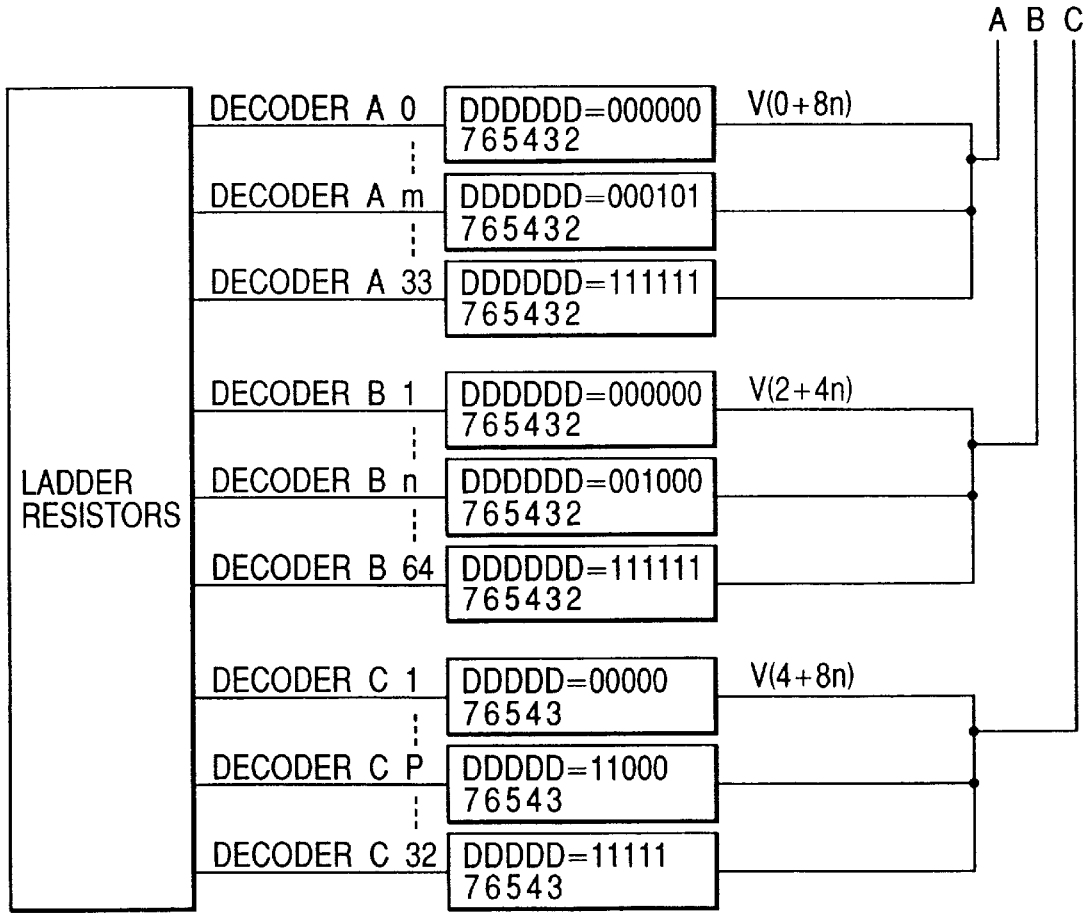
FIG. 11 is an overall configuration for explaining further a first decoder of the second embodiment of the present invention.

FIG. 11 is an overall configuration for explaining further the first decoder of the present embodiment of FIG. 10. The first decoder inputs the gray-scale voltages from a voltage-dividing resistance circuit (a resistive-ladder network) into the decoders A, B and C. The decoders A and B are configured for 6-bit data, and are supplied with gray-scale voltages 0, . . . , m, . . . , 33 and gray-scale voltages 1, . . . , n, 64, respectively. The decoder C is half the decoders A and B in size, configured for 5-bit display data, and is supplied with gray-scale voltages 1, . . . , 32 from the resistive-ladder network.

The decoder A outputs gray-scale voltages V(0+8n) (n=0, 1, 2, 3, . . .) as an output A (VA), the decoder B outputs gray-scale voltages V(2+4n) (n=0, 1, 2, 3, . . .) as an output B (VB), and the decoder C outputs gray-scale voltages V(4+8n) (n=0, 1, 2, 3, . . .) as an output C (VC).

Figure 12:
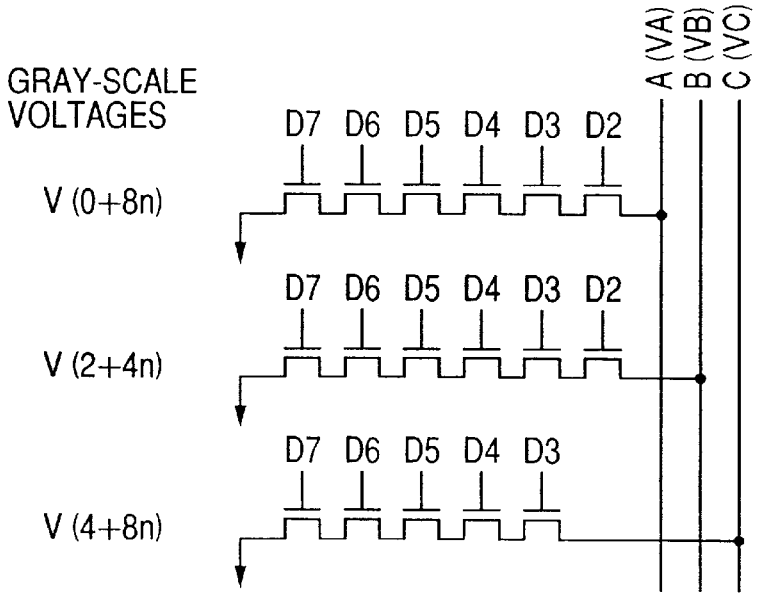
FIG. 12 is a schematic illustration of MOS configuration of the first decoder of FIG. 11.

FIG. 12 is a schematic illustration of MOS configuration of the first decoder of FIG. 11. The gray-scale voltages V(0+8n) inputted to the decoder A pass through six MOS transistors and are selected in accordance with display data D7, D6, D5, D4, D3 and D2 to provide the output A (VA). In the same way, the gray-scale voltages V(2+4n) inputted to the decoder B pass through six MOS transistors and are selected in accordance with display data D7, D6, D5, D4, D3 and D2 to provide the output B (VB). The gray-scale voltages V(4+8n) inputted to the decoder C pass through five MOS transistors and are selected in accordance with display data D7, D6, D5, D4 and D3 to provide the output C (VC).

Figure 13:
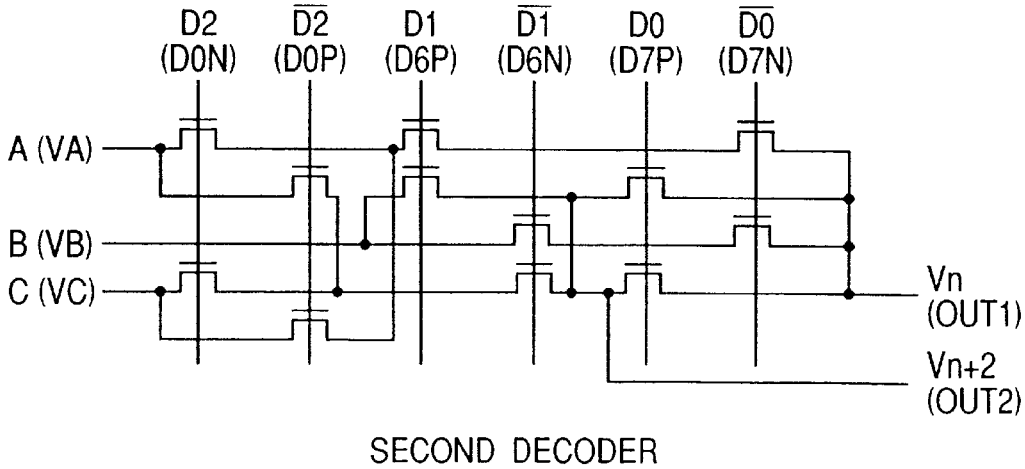
FIG. 13 is a schematic illustration of MOS configuration of the second decoder of FIG. 10.

FIG. 13 is a schematic illustration of MOS configuration of the second decoder of FIG. 10. As explained in connection with FIG. 10, the inputs A (VA), B (VB) and C (VC) supplied from the first decoder are selected in accordance with the display data D2 (D0N), the inverted D2 (D0F, hereinafter represented by a bar over D2 in FIG. 13), and the display data D1, the inverted D1, D0 and the inverted D0 are decoded to provide the output Vn (OUT1) and Vn+2 (OUT2).

Figure 14:
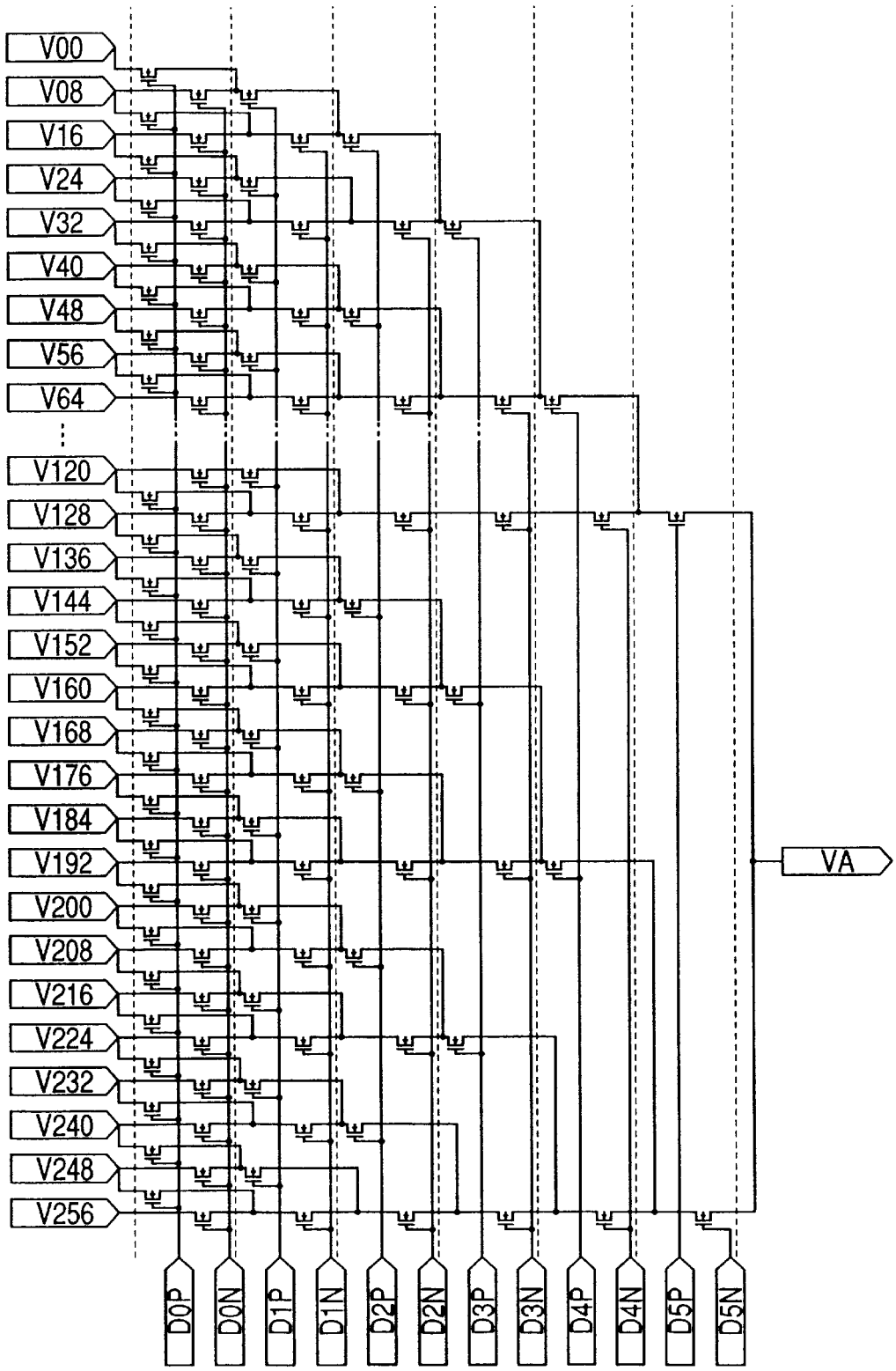
FIG. 14 is a concrete circuit of a tournament 1 in FIG. 10.
Figure 15:
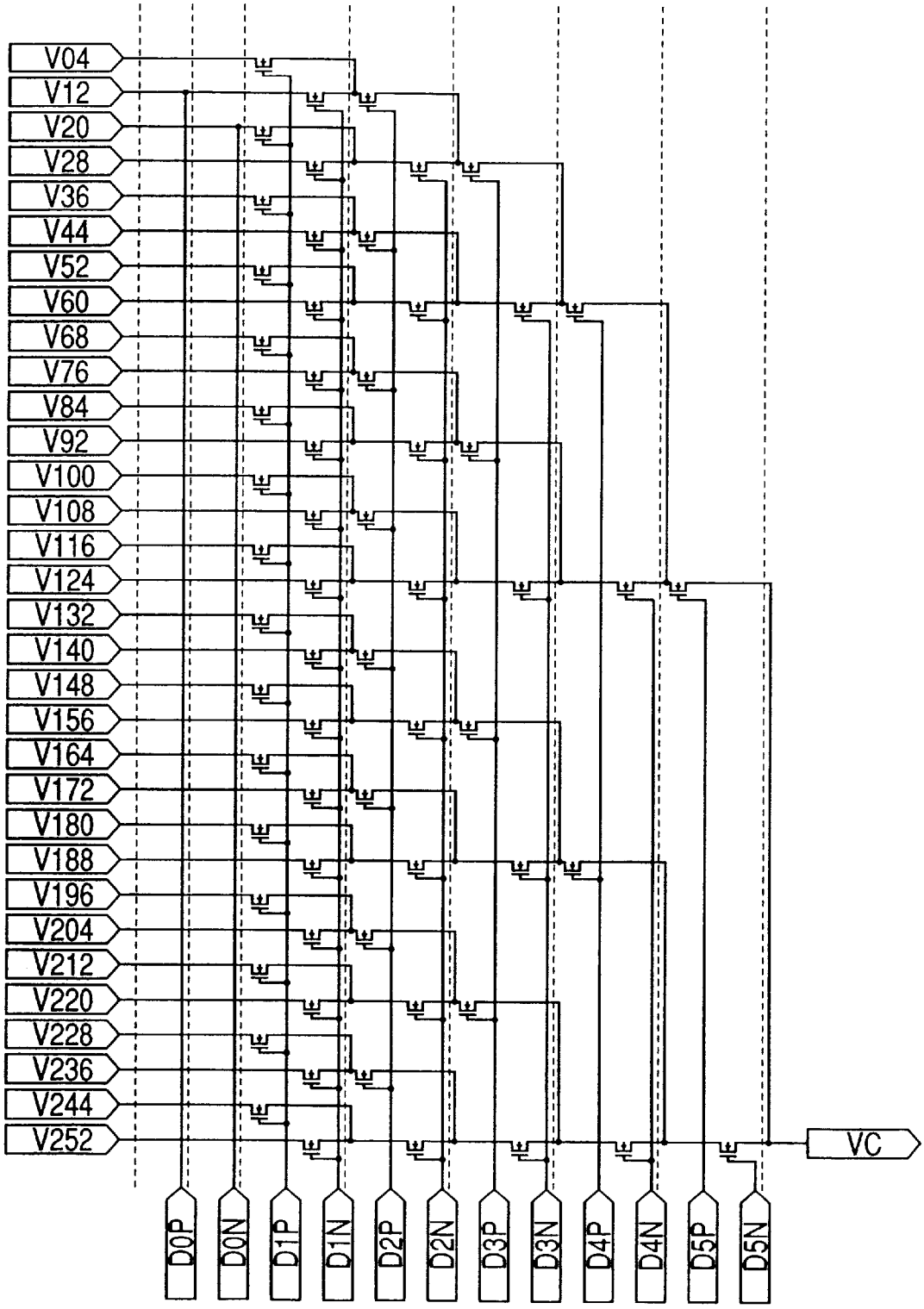
FIG. 15 is a concrete circuit of a tournament 3 in FIG. 10.

FIG. 14 is a concrete circuit of the tournament 1 in FIG. 10 and FIG. 15 is a concrete circuit of the tournament 3 in FIG. 10. In FIG. 14, the tournament 1 is supplied with the gray-scale voltages V(0+8n) (V00, V08, V16, V248, V256), and decodes the display data D0P, D0N, D1P, D1N, D2P, D2N, D3P, D3N, D4P, D4N, D5P and D5N to provide the output VA. In the similar way, the tournament 2 is supplied with the gray-scale voltages V(2+4n) (V02, V06, V10, V14, . . . , V250, V254), and decodes the display data D0P, D0N, D1P, D1N, D2P, D2N, D3P, D3N, D4P, D4N, D5P and D5N to provide the output VB.

The tournament 3 is supplied with the gray-scale voltages V(4+8n) (V04, V12, V20, . . . , V244, V252), and decodes the display data D0P, D0N, D1P, D1N, D2P, D2N, D3P, D3N, D4P, D4N, D5P and D5N to provide the output VC.

According to this embodiment, the 256 conventional eight-MOS decoders are reduced to the 64 six-MOS decoders, 33 six-MOS decoders and 32 five-MOS transistors in the first decoder and the second decoder. The number of inputs to the first decoder, that is, the number of the gray-scale voltage lines is 128.

Therefore improvement of quality of a display image of the liquid crystal panel and reduction of the border areas around the display area of the liquid crystal display device are realized by suppressing the increase of IC chip sizes of the drain drivers even when the number of gray-scales is increased to 256. Further, the total on-resistance of the decoders can be reduced such that the increase of time delay of gray-scale voltage outputs is suppressed and thereby increasing of resolution and speed-up of the liquid crystal panel are realized.

Figure 16:
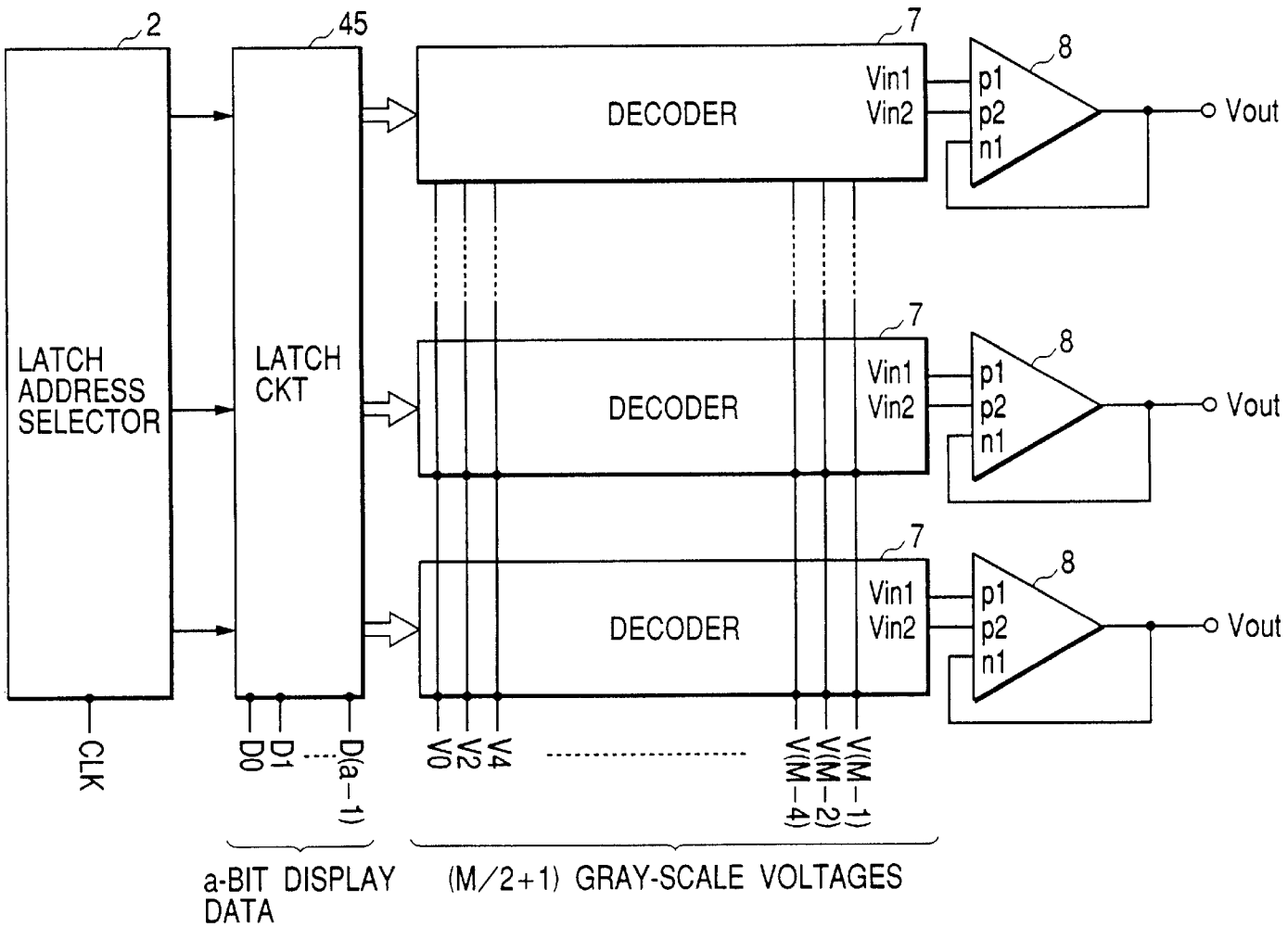
FIG. 16 is a block diagram illustrating a configuration of a drain driver of a TFT active matrix type liquid crystal display device of a third embodiment of the present invention.

FIG. 16 is a block diagram illustrating a configuration of a drain driver of a TFT active matrix type liquid crystal display device (a TFT liquid crystal display device) of a third embodiment of the present invention. This embodiment assumes that display data consists of a bits D0 to D(a−1), and gray-scale voltages are V0, V2, V4, . . . , V(M−4), V(M−2) and V(M−1).

The drain driver comprises a latch address selector 2, a latch circuit 45, decoders 7 and output amplifiers 8. As explained above, the gray-scale voltages to be inputted are a number (M+1)/2 of gray-scale voltages V0, V2, V4, . . . , V(M−3) and V(M−1) when the total number M of gray-scale to be displayed is odd, and a number (M/2+1) of gray-scale voltages V0, V2, V4, . . . , V(M−4), V(M−2) and V(M−1) when the total number M of gray-scales to be displayed is even.

Figure 17:
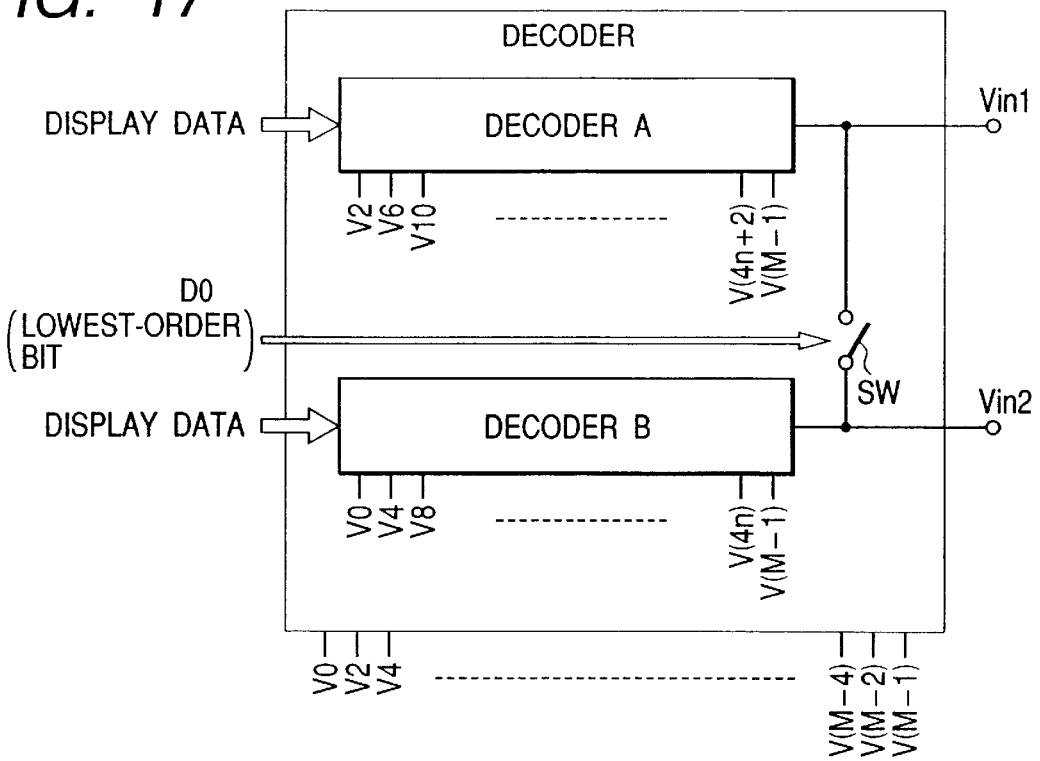
FIG. 17 is a block diagram for explaining a detail of a decoder in FIG. 16.

FIG. 17 is a block diagram for explaining a detail of the decoder in FIG. 16. It is assumed that an output of a decoder B supplied with the (4n+1)st gray-scale voltages (n=0, 1, 2, 3, . . .) in FIG. 16 is Vin2 and an output of a decoder A supplied with the (4n+3)rd gray-scale voltages (n=0, 1, 2, 3, . . .) in FIG. 16 is Vin1.

Figure 18:
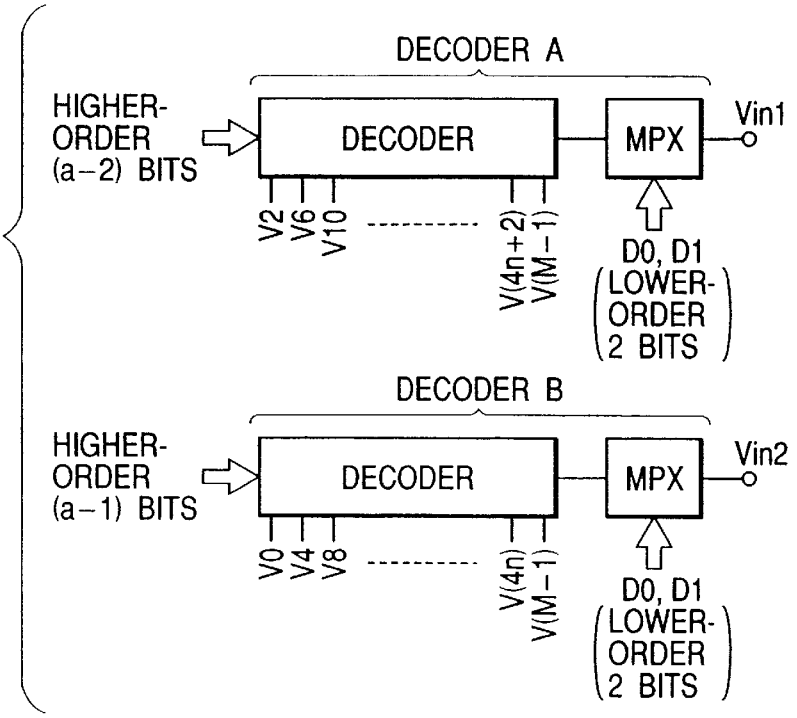
FIG. 18 is an illustration for explaining the operation of the decoder of FIG. 17.

FIG. 18 is an illustration for explaining the operation of the decoder of FIG. 17. The decoder of FIG. 17 will be explained by referring to FIG. 18.

When it is desired that both Vin1 and Vin2 output the same gray-scale voltage, V2, for example, the decoder A selects the gray-scale voltage V2, the decoder B is turned off (in a high-impedance state), and Vin1 and Vin2 are short-circuited by a switch SW controlled by the LSB (D0 in FIG. 17), thereby both Vin1 and Vin2 becoming V2.

When it is desired that Vin1 and Vin2 output two gray-scale voltages close to each other, V0 and V2, for example, respectively, the decoder A selects V2 and the decoder B selects V0 such that the outputs Vin1 and Vin2 output V2 and V0, respectively.

We shall now consider the case in which all the bits of a display data representing the lowest gray-scale are 0s, and Table II shows an example of a relationship among display data, decoder-selected voltages and output voltages of the output amplifier (denoted by "AMP OUTPUT" in Table II) for a 256 gray-scale display. It is needless to say that the same relationship with display data holds good even if 0s and is are interchanged.

The drain drivers for the TFT type liquid crystal panel are required to output gray-scale voltages in accordance with these display data. When an input display data represents a gray-scale voltage which needs to be synthesized in the output amplifier, the driver needs to select two gray-scale voltages different from the gray-scale voltage represented by the display data, from among the gray-scale voltages supplied to the drain drivers.

Consider the case in which a gray-scale corresponding to the voltage V7 is desired to be displayed, then the input display data V7=00000111 gray-scale voltages V6=00000110 gray-scale voltages V8=00001000.

Next, the operations of the decoders A and B will be explained.

In the decoder A for outputting the (4n+3)rd gray-scale voltages V(4n+2) (n=0, 1, 2, 3, . . .), the case in which the gray-scale voltage V6, for example, needs to be selected is one in which an input display data represents the gray-scale voltage V5, V6 or V7, and the following are corresponding display data:

V6: 00000110

V5: 00000101

V7: 00000111

When, as in a display data corresponding to the gray-scale voltage V6, V5 or V7, the lower-order 2 bits of the input display data are different from "00", the desired gray-scale voltage V6 can be selected in the decoder A by using the higher-order 6 bits of the input display data only On the other hand, when the lower-order 2 bits of the input display data are "00", the other decoder B for outputting the (4n+1)st gray-scale voltages V(4n) (n=0, 1, 2, 3, . . .) outputs a gray-scale voltage and the decoder A is turned off.

That is to say, the decoder A is configured so as to provide an output determined by higher-order 6 bits of an input display data only, except in the case in which the lower-order 2 bits of the input display data are "00."

In the decoder B for outputting the (4n+1)st gray-scale voltages V(4n) (n=0, 1, 2, 3, . . .), the case in which the gray-scale voltage V8, for example, needs to be selected is one in which an input display data represents the gray-scale voltage V7, V8 or V9, and the following are corresponding display data:

V7: 00000111

V8: 00001000

V9: 00001001

Each display data corresponding to the (4n+1)st gray-scale voltages V(4n) has a carry-produced bit configuration and its lower-order bit configuration is greatly different from that of a display data corresponding to a gray-scale immediately preceding the (4n+1)st gray-scale (note a difference in the lower-order 4 bits between the display data for V7 and V8, for example), and therefore it is not possible to select V8 only, by using the higher-order 6 bits of the input display data for an intended display.

Both the higher-order 6 bits of V7 and the higher-order 6 bits of V4 in a group of the (4n+1)st gray-scale voltages and immediately preceding V7 are "000001" and consequently, although only V8 is intended to be selected for the purpose of displaying V7, even V4 is also selected such that V4 and V8 are short-circuited to each other and a defective display is produced. Therefore, it is necessary to use the higher-order 7 bits of the input display data.

Consider the case in which an input display data represents V7, V8 or V9. Only V8 can be selected from among the group of the (4n+1)st gray-scale voltages by using the higher-order 7 bits of the input display data. In this case, if the lower-order 2 bits of the input display data is "10", the decoder B is turned off. If the lower-order 2 bits of the input display data is "10", the decoder A is configured so as to output one of the (4n+3)rd gray-scale voltages, the decoder B for outputting the (4n+1)st gray-scale voltages needs to be turned off.

That is to say, the decoder B is configured so as to provide an output determined by higher-order 7 bits of an input display data only, except in the case in which the lower-order 2 bits of the input display data are "10."

The column "DECODER-SELECTED VOLTAGES" in Table II is intended to indicate combinations of Vin1 and Vin2 only, and therefore some gray-scale voltages in the Vin1 and Vin2 columns in Table II are indicated in the order reversed from those in FIG. 17.

Figure 19:
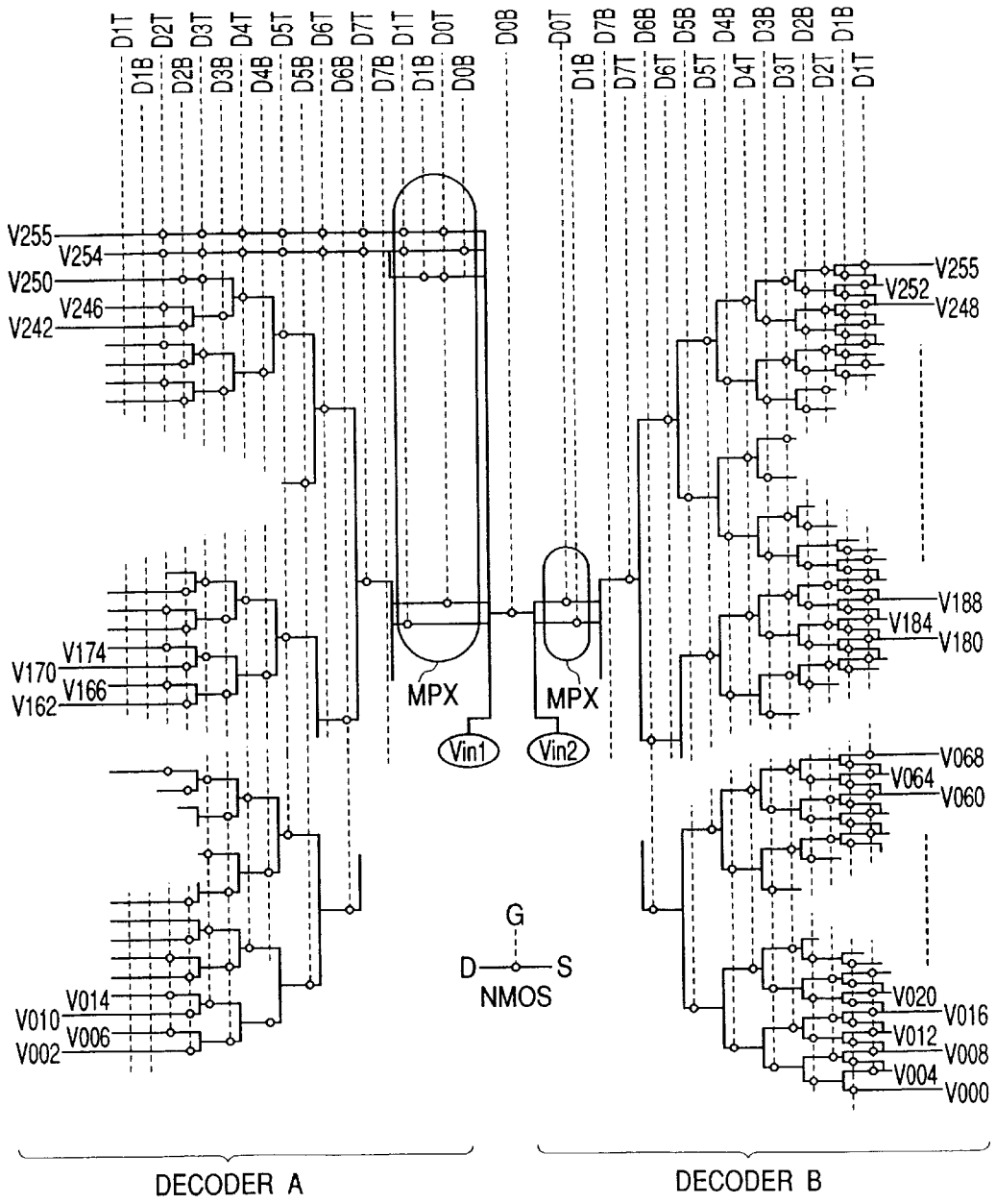
FIG. 19 is an actual circuit configuration embodying the decoder of FIG. 18.

FIG. 19 is an illustration of a portion of an actual circuit configuration embodying a low-voltage (negative-polarity) circuit portion of the decoder of FIG. 18. A high-voltage (positive-polarity) circuit portion of the decoder is obtained by interchanging B's and T's in the input data D0B, D0T, . . . , D7B, D7T, and replacing all the NMOS transistors with PMOS transistors in FIG. 19.

FIGS. 20A to 20C are graphs for explaining operating characteristics of the drain driver. FIG. 20A is a graph showing a relationship between brightness and voltages applied across the liquid crystal layer, FIG. 20B is a graph showing a relationship between gray-scale steps and drain driver output voltages, and FIG. 20C is a graph showing a relationship between brightness and gray-scale steps. As is shown in FIG. 20B, the relationship between the outputs of the drain driver and gray-scale steps are not linear.

When two input voltages are supplied to the output amplifier using a difference amplifier subsequently described so as to obtain a voltage midway between the two input voltages, an output voltage tends to be deviated toward one of the two input voltages from the midway voltage if a voltage difference between the two input voltages is excessively large, as shown in FIG. 20B.

Currents in the difference-amplifying portion of the output amplifier are $(½)\cdot\beta(V0-Vth)^2$ and $(½)\cdot\beta(V2-Vth)^2$ when V0 and V2 are inputted to the output amplifier, respectively. The difference between V0 and V2 produces quadratic effects when it becomes greater, assuming the threshold voltages Vth are approximately equal, and consequently, if V2>V0 is assumed, for example, the current will be close to a current provided by supplying V2 to both the inputs, and the synthesized output voltage will be deviated toward V2. But, if the difference between V0 and V2 is small, the synthesized output voltage will be an approximately midway voltage between the two input voltages.

The B-V curve of FIG. 20A illustrating the relationship between brightness and voltages applied across the liquid crystal layer is nonlinear. In both the relatively higher-brightness portion and the relatively lower-brightness portion of the B-V curve, the change of required magnitude of the voltages applied across the liquid crystal layer with brightness is considered usually larger, and therefore linear brightness gray-scale change is not realized by synthesizing of gray-scale voltages using the brightness portions of the B-V curve in the output amplifier.

Therefore it is necessary that output gray-scale voltages corresponding to those brightness portions are voltages supplied from the gray-scale voltage generator circuit, but not voltages synthesized by the output amplifier.

In view of the above-mentioned fact, a fourth embodiment of the present invention has eliminated compressing of whites and blacks in a gray-scale display as shown in FIG. 20C by combining the characteristic of the liquid crystal shown in FIG. 20A and that of the drain drivers shown in FIG. 20B. At least one of processes 1 to 5 described in Table III is employed to avoid degradation of a display image. This embodiment provides a high-quality multi-gray scale in all the gray-scale steps.

Figure 21:
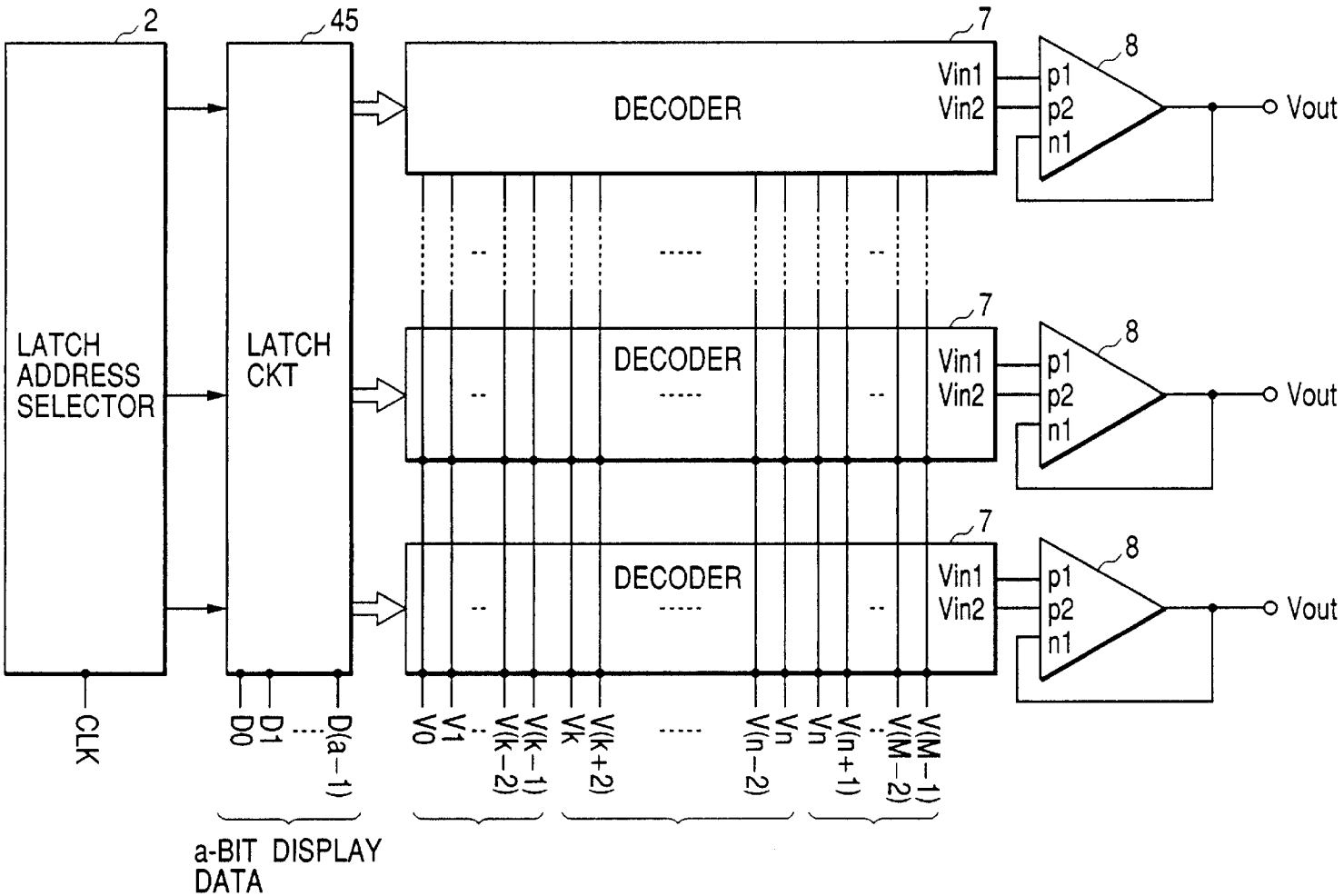
FIG. 21 is a block diagram illustrating a configuration of a drain driver of a TFT active matrix type liquid crystal display device of a fourth embodiment of the present invention.

FIG. 21 is a block diagram illustrating a configuration of a drain driver of a TFT active matrix type liquid crystal display device (a TFT liquid crystal display device) of a fourth embodiment of the present invention. In this embodiment, gray-scale voltages corresponding to a number k of the lower gray-scales and a number (M−n) of the upper gray-scales among the input gray-scale voltages V0, V2, V4, . . . , Vn, . . . , V(M−2) and V(M−1) of FIG. 16 are voltages supplied from the gray-scale voltage generator circuit, but not voltages synthesized by the output amplifier, as in the case of the conventional decoder in which the number of gray scales is equal to each of both the number of the input gray-scale voltages and the number of the output gray-scale voltages. This embodiment employs the processes I, IV and V of Table III, and the remaining configuration and operation of this embodiment is similar to those of the third embodiment in connection with FIG. 16.

This embodiment also provides a high-quality multi-gray scale in all the gray-scale steps.

Figure 22:
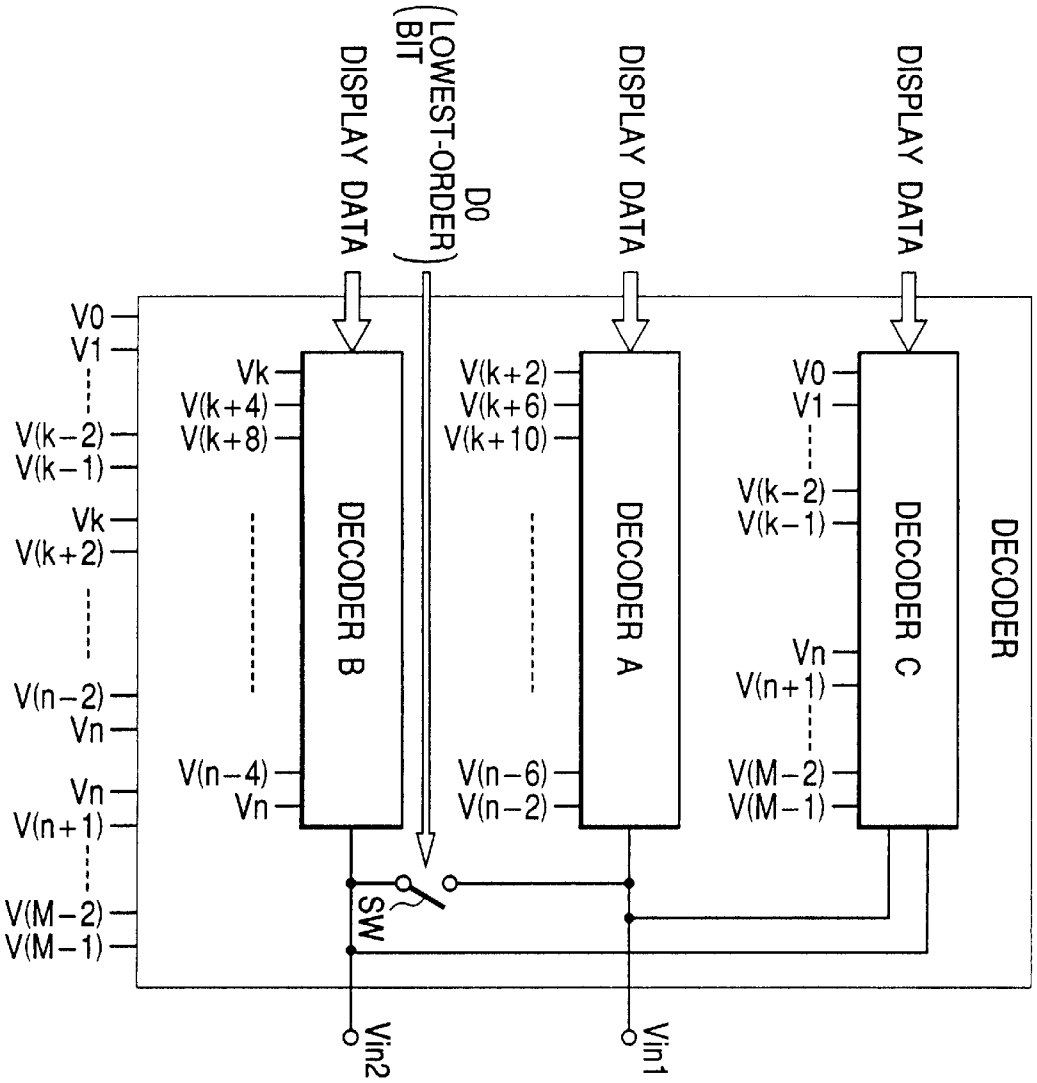
FIG. 22 is a block diagram for explaining a detail of a decoder in FIG. 21.

FIG. 22 is a block diagram for explaining a detail of the decoder in FIG. 21. There is added to the decoder of FIG. 17 a decoder C which receives all the gray-scale voltages corresponding to a number k of the lower gray-scales and a number (M−n) of the upper gray-scales from the gray-scale voltage generator circuit and outputs one of those gray-scale voltages in accordance with an input display data without any synthesis of gray-scale voltages.

Two outputs Vin1 and Vin2 of the decoder C are supplied with the same gray-scale voltages in accordance with an input display data. The decoders A and B are the same as those of FIG. 19, and the explanation about those are omitted.

Table IV shows an example of a relationship among input display data, decoder-selected voltages and output voltages of the output amplifier (denoted by "AMP OUTPUT" in Table IV) in this embodiment, assuming input gray-scale voltages are V0 to V255.

Here, the input gray-scale voltages V0 to V31 and V224 to V255 are related to the decoder C, and V32 to V233 are related to the decoders A and B, and are the same as in Table I.

Figure 23:
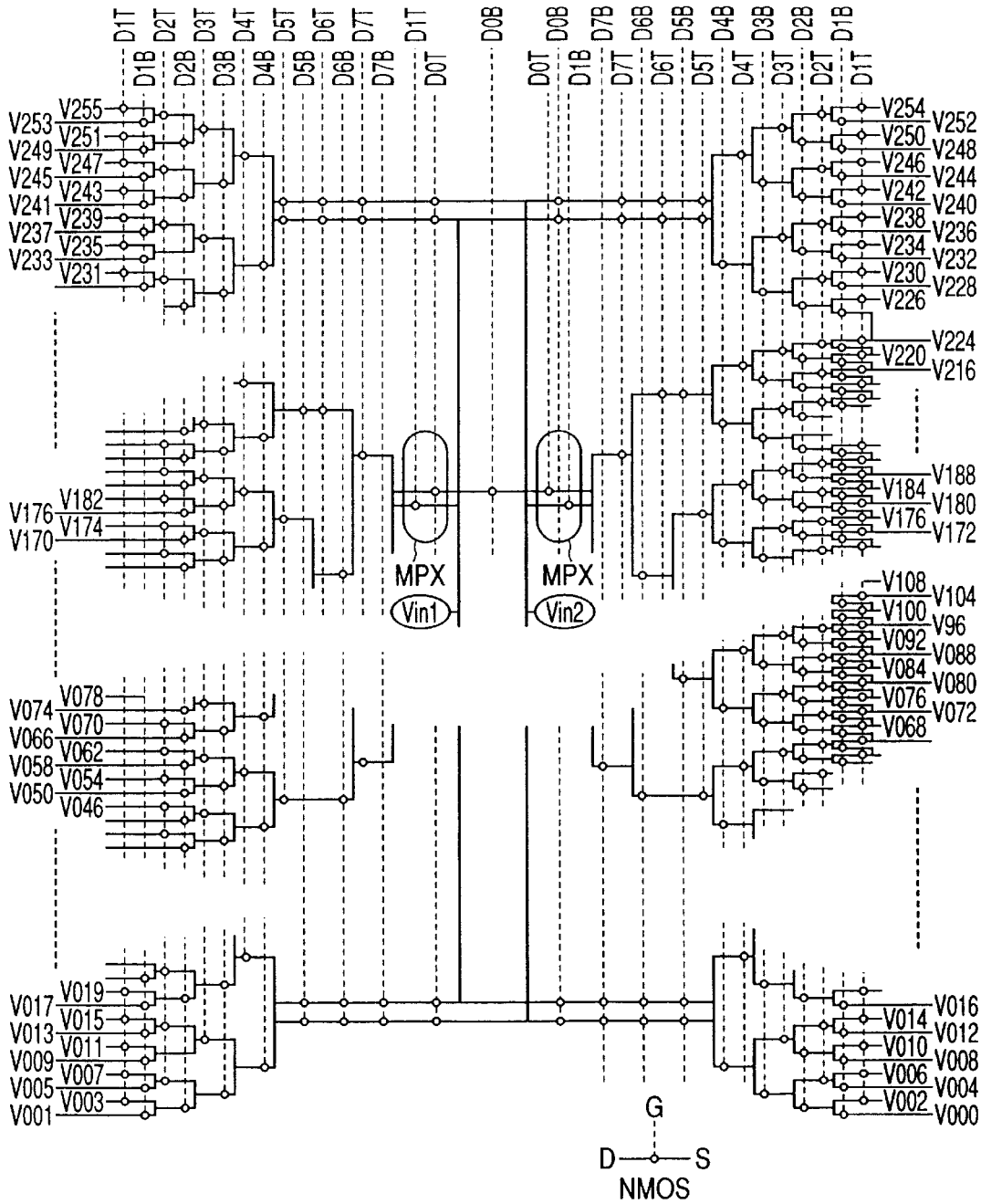
FIG. 23 is an actual circuit configuration embodying the decoder of FIG. 22.
Figure 24:
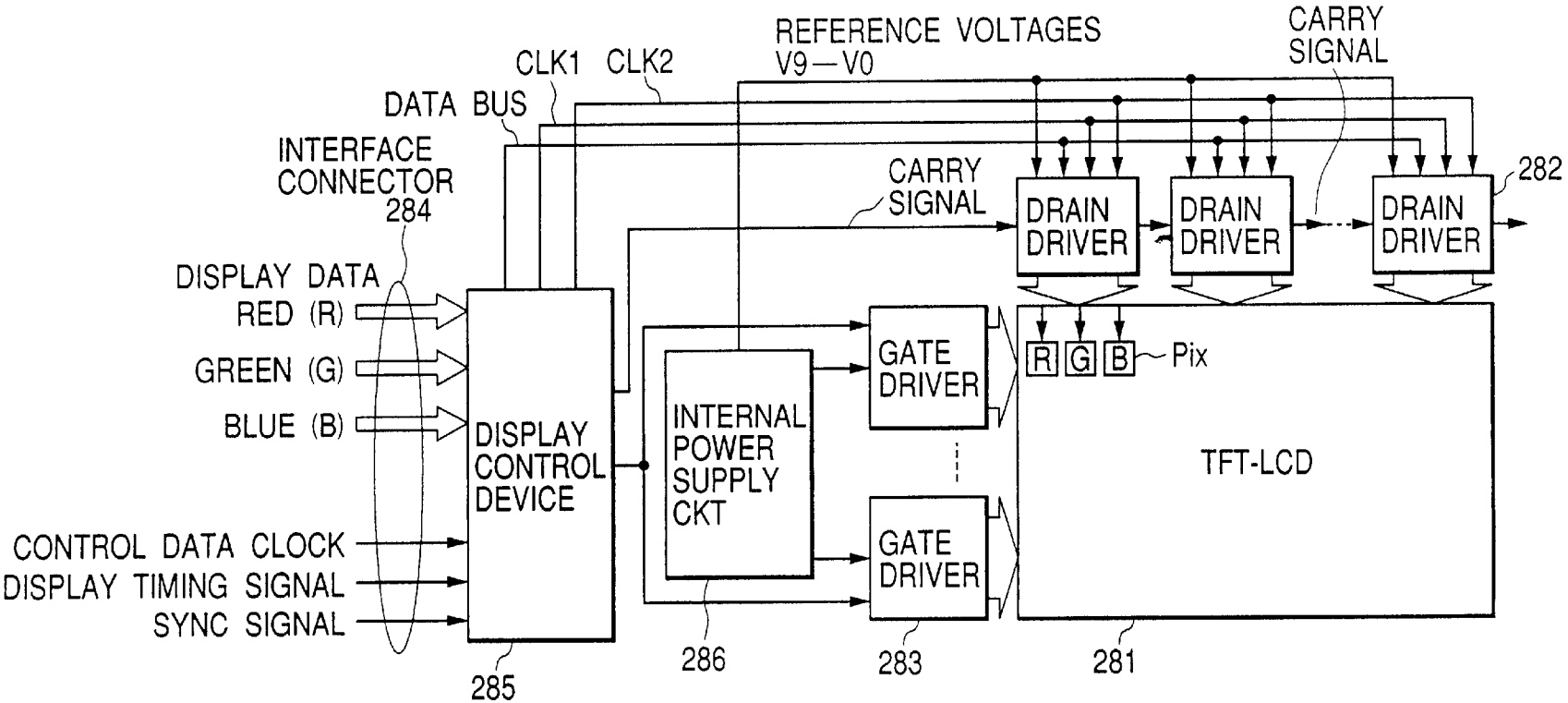
FIG. 24 is a schematic configuration of a liquid crystal display device to which the present invention is applied.

FIG. 23 is an illustration of a portion of an actual circuit configuration embodying a low-voltage (negative-polarity)

circuit portion of the decoder of the fourth embodiment of the present invention explained in connection with FIG. 22. A high-voltage (positive-polarity) circuit portion of the decoder is obtained by interchanging B's and T's in the input data D0B, D0T, . . . , D7B, D7T, and replacing all the NMOS transistors with PMOS transistors in FIG. 23.

This embodiment also provides a high-quality multi-gray scale in all the gray-scale steps.

As explained above, the present invention can increase the steps of gray-scales without increasing the IC chip sizes, improve the display quality of the liquid crystal panel, reduce the border areas around the display area of the liquid crystal display device, and suppress the increase in the on-resistance of the decoders, thereby reducing the load on the multi-gray scale liquid crystal panel and improving the image quality.

In accordance with the present invention, the output voltages of M gray-scale steps are generated by using (M+1)/2 input voltages if the number M is odd, or using (M/2+1) input voltages if the number M is even, and consequently, the circuit size of the drain drivers is reduced so as to reduce the area of the chip, output voltages matched with γ characteristics of the liquid crystal are obtained, the cost of the TFT liquid crystal panel is brought down and the border areas around the display area of the liquid crystal display device are reduced.

TABLE I

| GRAY-SCALE VOLTAGES | DECODER INPUT: DECODER NUMBERS | DECODER INPUT: INPUT VOLTAGES | DIGITAL INPUT BITS | | | | | | MULTIPLEXER INPUT VOLTAGES | | | DIGITAL INPUT BITS (LOWER-ORDER 2 BITS) | | MULTI-PLEXER-SELECTED VOLTAGES | | AMP OUTPUT |
|---|---|---|---|---|---|---|---|---|---|---|---|---|---|---|---|---|
| | | | D7 | D6 | D5 | D4 | D3 | D2 | A | B | C | D1 | D0 | Vin1 | Vin2 | |
| V000 | 0 | V000 | 0 | 0 | 0 | 0 | 0 | 0 | V000 | V002 | V004 | 0 | 0 | A | A | V000 |
| V001 | | — | 0 | 0 | 0 | 0 | 0 | 0 | | | | 0 | 1 | A | B | V001(SYNTHESIZED) |
| V002 | | V002 | 0 | 0 | 0 | 0 | 0 | 0 | | | | 1 | 0 | B | B | V002 |
| V003 | | — | 0 | 0 | 0 | 0 | 0 | 0 | | | | 1 | 1 | B | C | V003(SYNTHESIZED) |
| V004 | 1 | V004 | 0 | 0 | 0 | 0 | 0 | 1 | V004 | V006 | V008 | 0 | 0 | A | A | V004 |
| V005 | | — | 0 | 0 | 0 | 0 | 0 | 1 | | | | 0 | 1 | A | B | V005(SYNTHESIZED) |
| V006 | | V006 | 0 | 0 | 0 | 0 | 0 | 1 | | | | 1 | 0 | B | B | V006 |
| V007 | | — | 0 | 0 | 0 | 0 | 0 | 1 | | | | 1 | 1 | B | C | V007(SYNTHESIZED) |
| V008 | 2 | V008 | 0 | 0 | 0 | 0 | 1 | 0 | V008 | V010 | V012 | 0 | 0 | A | A | V008 |
| V009 | | — | 0 | 0 | 0 | 0 | 1 | 0 | | | | 0 | 1 | A | B | V009(SYNTHESIZED) |
| V010 | | V010 | 0 | 0 | 0 | 0 | 1 | 0 | | | | 1 | 0 | B | B | V010 |
| V011 | | — | 0 | 0 | 0 | 0 | 1 | 0 | | | | 1 | 1 | B | C | V011(SYNTHESIZED) |
| V012 | 3 | V012 | 0 | 0 | 0 | 0 | 1 | 1 | V012 | V014 | V016 | 0 | 0 | A | A | V012 |
| V013 | | — | 0 | 0 | 0 | 0 | 1 | 1 | | | | 0 | 1 | A | B | V013(SYNTHESIZED) |
| V014 | | V014 | 0 | 0 | 0 | 0 | 1 | 1 | | | | 1 | 0 | B | B | V014 |
| V015 | | — | 0 | 0 | 0 | 0 | 1 | 1 | | | | 1 | 1 | B | C | V015(SYNTHESIZED) |
| V016 | 4 | V016 | 0 | 0 | 0 | 1 | 0 | 0 | V016 | V018 | V020 | 0 | 0 | A | A | V016 |
| V017 | | — | 0 | 0 | 0 | 1 | 0 | 0 | | | | 0 | 1 | A | B | V017(SYNTHESIZED) |
| V018 | | V018 | 0 | 0 | 0 | 1 | 0 | 0 | | | | 1 | 0 | B | B | V018 |
| V019 | | — | 0 | 0 | 0 | 1 | 0 | 0 | | | | 1 | 1 | B | C | V019(SYNTHESIZED) |
| V020 | 5 | V020 | 0 | 0 | 0 | 1 | 0 | 1 | V020 | V022 | V024 | 0 | 0 | A | A | V020 |
| V021 | | — | 0 | 0 | 0 | 1 | 0 | 1 | | | | 0 | 1 | A | B | V021(SYNTHESIZED) |
| V022 | | V022 | 0 | 0 | 0 | 1 | 0 | 1 | | | | 1 | 0 | B | B | V022 |
| V023 | | — | 0 | 0 | 0 | 1 | 0 | 1 | | | | 1 | 1 | B | C | V023(SYNTHESIZED) |
| V024 | 6 | V024 | 0 | 0 | 0 | 1 | 1 | 0 | V024 | V026 | V028 | 0 | 0 | A | A | V024 |
| V025 | | — | 0 | 0 | 0 | 1 | 1 | 0 | | | | 0 | 1 | A | B | V025(SYNTHESIZED) |
| V026 | | V026 | 0 | 0 | 0 | 1 | 1 | 0 | | | | 1 | 0 | B | B | V026 |
| V027 | | — | 0 | 0 | 0 | 1 | 1 | 0 | | | | 1 | 1 | B | C | V027(SYNTHESIZED) |
| V028 | 7 | V028 | 0 | 0 | 0 | 1 | 1 | 1 | V028 | V030 | V032 | 0 | 0 | A | A | V028 |
| V029 | | — | 0 | 0 | 0 | 1 | 1 | 1 | | | | 0 | 1 | A | B | V029(SYNTHESIZED) |
| V030 | | V030 | 0 | 0 | 0 | 1 | 1 | 1 | | | | 1 | 0 | B | B | V030 |
| V031 | | — | 0 | 0 | 0 | 1 | 1 | 1 | | | | 1 | 1 | B | C | V031(SYNTHESIZED) |
| V032 | 8 | V032 | 0 | 0 | 1 | 0 | 0 | 0 | V032 | V034 | V036 | 0 | 0 | A | A | V032 |
| V033 | | — | 0 | 0 | 1 | 0 | 0 | 0 | | | | 0 | 1 | A | B | V033(SYNTHESIZED) |
| V034 | | V034 | 0 | 0 | 1 | 0 | 0 | 0 | | | | 1 | 0 | B | B | V034 |
| V035 | | — | 0 | 0 | 1 | 0 | 0 | 0 | | | | 1 | 1 | B | C | V035(SYNTHESIZED) |
| V036 | 9 | V036 | 0 | 0 | 1 | 0 | 0 | 1 | V036 | V038 | V040 | 0 | 0 | A | A | V036 |
| V037 | | — | 0 | 0 | 1 | 0 | 0 | 1 | | | | 0 | 1 | A | B | V037(SYNTHESIZED) |
| V038 | | V038 | 0 | 0 | 1 | 0 | 0 | 1 | | | | 1 | 0 | B | B | V038 |
| V039 | | — | 0 | 0 | 1 | 0 | 0 | 1 | | | | 1 | 1 | B | C | V039(SYNTHESIZED) |
| . | . | . | . | . | . | . | . | . | . | . | . | . | . | . | . | . |
| . | . | . | . | . | . | . | . | . | . | . | . | . | . | . | . | . |
| . | . | . | . | . | . | . | . | . | . | . | . | . | . | . | . | . |
| V216 | 54 | V216 | 1 | 1 | 0 | 1 | 1 | 0 | V216 | V218 | V220 | 0 | 0 | A | A | V216 |
| V217 | | — | 1 | 1 | 0 | 1 | 1 | 0 | | | | 0 | 1 | A | B | V217(SYNTHESIZED) |
| V218 | | V218 | 1 | 1 | 0 | 1 | 1 | 0 | | | | 1 | 0 | B | B | V218 |
| V219 | | — | 1 | 1 | 0 | 1 | 1 | 0 | | | | 1 | 1 | B | C | V219(SYNTHESIZED) |
| V220 | 55 | V220 | 1 | 1 | 0 | 1 | 1 | 1 | V220 | V222 | V224 | 0 | 0 | A | A | V220 |
| V221 | | — | 1 | 1 | 0 | 1 | 1 | 1 | | | | 0 | 1 | A | B | V221(SYNTHESIZED) |
| V222 | | V222 | 1 | 1 | 0 | 1 | 1 | 1 | | | | 1 | 0 | B | B | V222 |
| V223 | | — | 1 | 1 | 0 | 1 | 1 | 1 | | | | 1 | 1 | B | C | V223(SYNTHESIZED) |
| V224 | 56 | V224 | 1 | 1 | 1 | 0 | 0 | 0 | V224 | V226 | V228 | 0 | 0 | A | A | V224 |
| V225 | | — | 1 | 1 | 1 | 0 | 0 | 0 | | | | 0 | 1 | A | B | V225(SYNTHESIZED) |

TABLE I-continued

| GRAY-SCALE VOLTAGES | DECODER INPUT: DECODER NUMBERS | DECODER INPUT: INPUT VOLTAGES | DIGITAL INPUT BITS: D7 | D6 | D5 | D4 | D3 | D2 | MULTIPLEXER INPUT VOLTAGES: A | B | C | DIGITAL INPUT BITS (LOWER-ORDER 2 BITS): D1 | D0 | MULTI-PLEXER-SELECTED VOLTAGES: Vin1 | Vin2 | AMP OUTPUT |
|---|---|---|---|---|---|---|---|---|---|---|---|---|---|---|---|---|
| V226 | | V226 | 1 | 1 | 1 | 0 | 0 | 0 | | | | 1 | 0 | B | B | V226 |
| V227 | | — | 1 | 1 | 1 | 0 | 0 | 0 | | | | 1 | 1 | B | C | V227(SYNTHESIZED) |
| V228 | 57 | V228 | 1 | 1 | 1 | 0 | 0 | 1 | V228 | V230 | V232 | 0 | 0 | A | A | V228 |
| V229 | | — | 1 | 1 | 1 | 0 | 0 | 1 | | | | 0 | 1 | A | B | V229(SYNTHESIZED) |
| V230 | | V230 | 1 | 1 | 1 | 0 | 0 | 1 | | | | 1 | 0 | B | B | V230 |
| V231 | | — | 1 | 1 | 1 | 0 | 0 | 1 | | | | 1 | 1 | B | C | V231(SYNTHESIZED) |
| V232 | 58 | V232 | 1 | 1 | 1 | 0 | 1 | 0 | V232 | V234 | V236 | 0 | 0 | A | A | V232 |
| V233 | | — | 1 | 1 | 1 | 0 | 1 | 0 | | | | 0 | 1 | A | B | V233(SYNTHESIZED) |
| V234 | | V234 | 1 | 1 | 1 | 0 | 1 | 0 | | | | 1 | 0 | B | B | V234 |
| V235 | | — | 1 | 1 | 1 | 0 | 1 | 0 | | | | 1 | 1 | B | C | V235(SYNTHESIZED) |
| V236 | 59 | V236 | 1 | 1 | 1 | 0 | 1 | 1 | V236 | V238 | V240 | 0 | 0 | A | A | V236 |
| V237 | | — | 1 | 1 | 1 | 0 | 1 | 1 | | | | 0 | 1 | A | B | V237(SYNTHESIZED) |
| V238 | | V238 | 1 | 1 | 1 | 0 | 1 | 1 | | | | 1 | 0 | B | B | V238 |
| V239 | | — | 1 | 1 | 1 | 0 | 1 | 1 | | | | 1 | 1 | B | C | V239(SYNTHESIZED) |
| V240 | 60 | V240 | 1 | 1 | 1 | 1 | 0 | 0 | V240 | V242 | V244 | 0 | 0 | A | A | V240 |
| V241 | | — | 1 | 1 | 1 | 1 | 0 | 0 | | | | 0 | 1 | A | B | V241(SYNTHESIZED) |
| V242 | | V242 | 1 | 1 | 1 | 1 | 0 | 0 | | | | 1 | 0 | B | B | V242 |
| V243 | | — | 1 | 1 | 1 | 1 | 0 | 0 | | | | 1 | 1 | B | C | V243(SYNTHESIZED) |
| V244 | 61 | V244 | 1 | 1 | 1 | 1 | 0 | 1 | V244 | V246 | V248 | 0 | 0 | A | A | V244 |
| V245 | | — | 1 | 1 | 1 | 1 | 0 | 1 | | | | 0 | 1 | A | B | V245(SYNTHESIZED) |
| V246 | | V246 | 1 | 1 | 1 | 1 | 0 | 1 | | | | 1 | 0 | B | B | V246 |
| V247 | | — | 1 | 1 | 1 | 1 | 0 | 1 | | | | 1 | 1 | B | C | V247(SYNTHESIZED) |
| V248 | 62 | V248 | 1 | 1 | 1 | 1 | 1 | 0 | V248 | V250 | V252 | 0 | 0 | A | A | V248 |
| V249 | | — | 1 | 1 | 1 | 1 | 1 | 0 | | | | 0 | 1 | A | B | V249(SYNTHESIZED) |
| V250 | | V250 | 1 | 1 | 1 | 1 | 1 | 0 | | | | 1 | 0 | B | B | V250 |
| V251 | | — | 1 | 1 | 1 | 1 | 1 | 0 | | | | 1 | 1 | B | C | V251(SYNTHESIZED) |
| V252 | 63 | V252 | 1 | 1 | 1 | 1 | 1 | 1 | V252 | V254 | V256 | 0 | 0 | A | A | V252 |
| V253 | | — | 1 | 1 | 1 | 1 | 1 | 1 | | | | 0 | 1 | A | B | V253(SYNTHESIZED) |
| V254 | | V254 | 1 | 1 | 1 | 1 | 1 | 1 | | | | 1 | 0 | B | B | V254 |
| V255 | | — | 1 | 1 | 1 | 1 | 1 | 1 | | | | 1 | 1 | B | C | V255(SYNTHESIZED) |
| — | | V256 | | | | | | | | | | | | | | |

TABLE II

| GRAY-SCALE VOLTAGES | DECODER INPUT: INPUT VOLTAGES | DECODER INPUT: SERIAL NUMBERS (n = 0, 1 . . .) | DIGITAL INPUT BITS: D7 | D6 | D5 | D4 | D3 | D2 | D1 | D0 | DECODER-SELECTED VOLTAGES: Vin1 | Vin2 | AMP OUTPUT |
|---|---|---|---|---|---|---|---|---|---|---|---|---|---|
| V0 | V0 | 4n + 1 | 0 | 0 | 0 | 0 | 0 | 0 | 0 | 0 | V0 | V0 | V0 |
| V1 | — | — | 0 | 0 | 0 | 0 | 0 | 0 | 0 | 1 | V0 | V2 | V1(SYNTHESIZED) |
| V2 | V2 | 4n + 3 | 0 | 0 | 0 | 0 | 0 | 0 | 1 | 0 | V2 | V2 | V2 |
| V3 | — | — | 0 | 0 | 0 | 0 | 0 | 0 | 1 | 1 | V2 | V4 | V3(SYNTHESIZED) |
| V4 | V4 | 4n + 1 | 0 | 0 | 0 | 0 | 0 | 1 | 0 | 0 | V4 | V4 | V4 |
| V5 | — | — | 0 | 0 | 0 | 0 | 0 | 1 | 0 | 1 | V4 | V6 | V5(SYNTHESIZED) |
| V6 | V6 | 4n + 3 | 0 | 0 | 0 | 0 | 0 | 1 | 1 | 0 | V6 | V6 | V6 |
| V7 | — | — | 0 | 0 | 0 | 0 | 0 | 1 | 1 | 1 | V6 | V8 | V7(SYNTHESIZED) |
| V8 | V8 | 4n + 1 | 0 | 0 | 0 | 0 | 1 | 0 | 0 | 0 | V8 | V8 | V8 |
| V9 | — | — | 0 | 0 | 0 | 0 | 1 | 0 | 0 | 1 | V8 | V10 | V9(SYNTHESIZED) |
| V10 | V10 | 4n + 3 | 0 | 0 | 0 | 0 | 1 | 0 | 1 | 0 | V10 | V10 | V10 |
| V11 | — | — | 0 | 0 | 0 | 0 | 1 | 0 | 1 | 1 | V10 | V12 | V11(SYNTHESIZED) |
| V12 | V12 | 4n + 1 | 0 | 0 | 0 | 0 | 1 | 1 | 0 | 0 | V12 | V12 | V12 |
| V13 | — | — | 0 | 0 | 0 | 0 | 1 | 1 | 0 | 1 | V12 | V14 | V13(SYNTHESIZED) |
| V14 | V14 | 4n + 3 | 0 | 0 | 0 | 0 | 1 | 1 | 1 | 0 | V14 | V14 | V14 |
| V15 | — | — | 0 | 0 | 0 | 0 | 1 | 1 | 1 | 1 | V14 | V16 | V15(SYNTHESIZED) |
| V16 | V16 | 4n + 1 | 0 | 0 | 0 | 1 | 0 | 0 | 0 | 0 | V16 | V16 | V16 |
| V17 | — | — | 0 | 0 | 0 | 1 | 0 | 0 | 0 | 1 | V16 | V18 | V17(SYNTHESIZED) |
| V18 | V18 | 4n + 3 | 0 | 0 | 0 | 1 | 0 | 0 | 1 | 0 | V18 | V18 | V18 |
| V19 | — | — | 0 | 0 | 0 | 1 | 0 | 0 | 1 | 1 | V18 | V20 | V19(SYNTHESIZED) |
| . | . | . | . | . | . | . | . | . | . | . | . | . | . |
| . | . | . | . | . | . | . | . | . | . | . | . | . | . |
| . | . | . | . | . | . | . | . | . | . | . | . | . | . |
| V252 | V252 | 4n + 1 | 1 | 1 | 1 | 1 | 1 | 1 | 0 | 0 | V252 | V252 | V252 |
| V253 | V253 | — | 1 | 1 | 1 | 1 | 1 | 1 | 0 | 1 | V252 | V254 | V253(SYNTHESIZED) |

TABLE II-continued

| GRAY-SCALE VOLTAGES | DECODER INPUT: INPUT VOLTAGES | DECODER INPUT: SERIAL NUMBERS (n = 0, 1 . . .) | DIGITAL INPUT BITS D7 | D6 | D5 | D4 | D3 | D2 | D1 | D0 | DECODER-SELECTED VOLTAGES Vin1 | Vin2 | AMP OUTPUT |
|---|---|---|---|---|---|---|---|---|---|---|---|---|---|
| V254 | V254 | 4n + 3 | 1 | 1 | 1 | 1 | 1 | 1 | 1 | 0 | V254 | V254 | V254 |
| V255 | V255 | — | 1 | 1 | 1 | 1 | 1 | 1 | 1 | 1 | V255 | V255 | V255 |

TABLE III

PROCESS 1

Gray-scale voltages supplied from a gray-scale voltage supply circuit (a gray-scale voltage generator circuit) are used for R gray-scale steps on the white side and for S gray-scale steps on the black side, without synthesizing any intermediate gray-scale voltages between gray-scale voltages supplied from the gray-scale voltage supply circuit in the output amplifier, to avoid compressing of whites and blacks.

PROCESS 2

Gray-scale voltages supplied from a gray-scale voltage supply circuit (a gray-scale voltage generator circuit) are used for R gray-scale steps on the white side, without synthesizing any intermediate gray-scale voltages between gray-scale voltages supplied from the gray-scale voltage supply circuit in the output amplifier, to avoid compressing of whites.

PROCESS 3

Gray-scale voltages supplied from a gray-scale voltage supply circuit (a gray-scale voltage generator circuit) are used for S gray-scale steps on the black side, without synthesizing any intermediate gray-scale voltages between gray-scale voltages supplied from the gray-scale voltage supply circuit in the output amplifier, to avoid compressing of blacks.

PROCESS 4

Gray-scale voltages supplied from a gray-scale voltage supply circuit (a gray-scale voltage generator circuit) are used for gray-scale steps in a region where a relationship between brightness and voltages across the liquid crystal layer is not linear, without synthesizing any intermediate gray-scale voltages between gray-scale voltages supplied from the gray-scale voltage supply circuit in the output amplifier, to avoid compressing of brightness in the region.

PROCESS 5

Gray-scale voltages supplied from a gray-scale voltage supply circuit are used for gray-scale steps in a region where a voltage difference between two successive gray-scale steps is comparatively large, without synthesizing any intermediate gray-scale voltages between gray-scale voltages supplied from the gray-scale voltage supply circuit in the output amplifier, to avoid a difficulty in synthesizing of a desired intermediate gray-scale voltage in the region in the output amplifier.

TABLE IV

| GRAY-SCALE VOLTAGES | DECODER INPUT: INPUT VOLTAGES | DECODER INPUT: SERIAL NUMBERS (n = 0, 1 . . .) | DIGITAL INPUT BITS D7 | D6 | D5 | D4 | D3 | D2 | D1 | D0 | DECODER-SELECTED VOLTAGES Vin1 | Vin2 | AMP OUTPUT | |
|---|---|---|---|---|---|---|---|---|---|---|---|---|---|---|
| V0 | V0 | — | 0 | 0 | 0 | 0 | 0 | 0 | 0 | 0 | V0 | V0 | V0 | AS SUPPLIED FROM GRAY-SCALE VOLTAGE SUPPLY CIRCUIT ↓ |
| V1 | V1 | — | 0 | 0 | 0 | 0 | 0 | 0 | 0 | 1 | V1 | V1 | V1 | |
| V2 | V2 | — | 0 | 0 | 0 | 0 | 0 | 0 | 1 | 0 | V2 | V2 | V2 | |
| V3 | V3 | — | 0 | 0 | 0 | 0 | 0 | 0 | 1 | 1 | V3 | V3 | V3 | |
| V4 | V4 | — | 0 | 0 | 0 | 0 | 0 | 1 | 0 | 0 | V4 | V4 | V4 | |
| V5 | V5 | — | 0 | 0 | 0 | 0 | 0 | 1 | 0 | 1 | V5 | V5 | V5 | |
| V6 | V6 | — | 0 | 0 | 0 | 0 | 0 | 1 | 1 | 0 | V6 | V6 | V6 | |
| V7 | V7 | — | 0 | 0 | 0 | 0 | 0 | 1 | 1 | 1 | V7 | V7 | V7 | |
| V8 | V8 | — | 0 | 0 | 0 | 0 | 1 | 0 | 0 | 0 | V8 | V8 | V8 | |
| V9 | V9 | — | 0 | 0 | 0 | 0 | 1 | 0 | 0 | 1 | V9 | V9 | V9 | |
| V10 | V10 | — | 0 | 0 | 0 | 0 | 1 | 0 | 1 | 0 | V10 | V10 | V10 | |
| V11 | V11 | — | 0 | 0 | 0 | 0 | 1 | 0 | 1 | 1 | V11 | V11 | V11 | |
| V12 | V12 | — | 0 | 0 | 0 | 0 | 1 | 1 | 0 | 0 | V12 | V12 | V12 | |
| V13 | V13 | — | 0 | 0 | 0 | 0 | 1 | 1 | 0 | 1 | V13 | V13 | V13 | |

TABLE IV-continued

| GRAY-SCALE VOLTAGES | DECODER INPUT: INPUT VOLTAGES | DECODER INPUT: SERIAL NUMBERS (n = 0, 1 . . .) | DIGITAL INPUT BITS D7 | D6 | D5 | D4 | D3 | D2 | D1 | D0 | DECODER-SELECTED VOLTAGES Vin1 | Vin2 | AMP OUTPUT | |
|---|---|---|---|---|---|---|---|---|---|---|---|---|---|---|
| V14 | V14 | — | 0 | 0 | 0 | 0 | 1 | 1 | 1 | 0 | V14 | V14 | V14 | |
| V15 | V15 | — | 0 | 0 | 0 | 0 | 1 | 1 | 1 | 1 | V15 | V15 | V15 | |
| V16 | V16 | — | 0 | 0 | 0 | 1 | 0 | 0 | 0 | 0 | V16 | V16 | V16 | |
| V17 | V17 | — | 0 | 0 | 0 | 1 | 0 | 0 | 0 | 1 | V17 | V17 | V17 | |
| V18 | V18 | — | 0 | 0 | 0 | 1 | 0 | 0 | 1 | 0 | V18 | V18 | V18 | |
| V19 | V19 | — | 0 | 0 | 0 | 1 | 0 | 0 | 1 | 1 | V19 | V19 | V19 | |
| V20 | V20 | — | 0 | 0 | 0 | 1 | 0 | 1 | 0 | 0 | V20 | V20 | V20 | |
| V21 | V21 | — | 0 | 0 | 0 | 1 | 0 | 1 | 0 | 1 | V21 | V21 | V21 | |
| V22 | V22 | — | 0 | 0 | 0 | 1 | 0 | 1 | 1 | 0 | V22 | V22 | V22 | |
| V23 | V23 | — | 0 | 0 | 0 | 1 | 0 | 1 | 1 | 1 | V23 | V23 | V23 | |
| V24 | V24 | — | 0 | 0 | 0 | 1 | 1 | 0 | 0 | 0 | V24 | V24 | V24 | |
| V25 | V25 | — | 0 | 0 | 0 | 1 | 1 | 0 | 0 | 1 | V25 | V25 | V25 | |
| V26 | V26 | — | 0 | 0 | 0 | 1 | 1 | 0 | 1 | 0 | V26 | V26 | V26 | |
| V27 | V27 | — | 0 | 0 | 0 | 1 | 1 | 0 | 1 | 1 | V27 | V27 | V27 | |
| V28 | V28 | — | 0 | 0 | 0 | 1 | 1 | 1 | 0 | 0 | V28 | V28 | V28 | |
| V29 | V29 | — | 0 | 0 | 0 | 1 | 1 | 1 | 0 | 1 | V29 | V29 | V29 | |
| V30 | V30 | — | 0 | 0 | 0 | 1 | 1 | 1 | 1 | 0 | V30 | V30 | V30 | |
| V31 | V31 | — | 0 | 0 | 0 | 1 | 1 | 1 | 1 | 1 | V31 | V31 | V31 | |
| V32 | V32 | 4n + 1 | 0 | 0 | 1 | 0 | 0 | 0 | 0 | 0 | V32 | V32 | V32 | SYNTHESIZED |
| V33 | — | — | 0 | 0 | 1 | 0 | 0 | 0 | 0 | 1 | V32 | V34 | V33(SYNTHESIZED) | ↓ |
| V34 | V34 | 4n + 3 | 0 | 0 | 1 | 0 | 0 | 0 | 1 | 0 | V34 | V34 | V34 | |
| V35 | — | — | 0 | 0 | 1 | 0 | 0 | 0 | 1 | 1 | V34 | V36 | V35(SYNTHESIZED) | |
| V36 | V36 | 4n + 1 | 0 | 0 | 1 | 0 | 0 | 1 | 0 | 0 | V36 | V36 | V36 | |
| V37 | — | — | 0 | 0 | 1 | 0 | 0 | 1 | 0 | 1 | V36 | V38 | V37(SYNTHESIZED) | |
| V38 | V38 | 4n + 3 | 0 | 0 | 1 | 0 | 0 | 1 | 1 | 0 | V38 | V38 | V38 | |
| V39 | — | — | 0 | 0 | 1 | 0 | 0 | 1 | 1 | 1 | V38 | V40 | V39(SYNTHESIZED) | |
| V40 | V40 | 4n + 1 | 0 | 0 | 1 | 0 | 1 | 0 | 0 | 0 | V40 | V40 | V40 | |
| V41 | — | — | 0 | 0 | 1 | 0 | 1 | 0 | 0 | 1 | V40 | V42 | V41(SYNTHESIZED) | |
| V42 | V42 | 4n + 3 | 0 | 0 | 1 | 0 | 1 | 0 | 1 | 0 | V42 | V42 | V42 | |
| V43 | — | — | 0 | 0 | 1 | 0 | 1 | 0 | 1 | 1 | V42 | V44 | V43(SYNTHESIZED) | |
| V44 | V44 | 4n + 1 | 0 | 0 | 1 | 0 | 1 | 1 | 0 | 0 | V44 | V44 | V44 | |
| V45 | — | — | 0 | 0 | 1 | 0 | 1 | 1 | 0 | 1 | V44 | V46 | V45(SYNTHESIZED) | |
| V46 | V46 | 4n + 3 | 0 | 0 | 1 | 0 | 1 | 1 | 1 | 0 | V46 | V46 | V46 | |
| V47 | — | — | 0 | 0 | 1 | 0 | 1 | 1 | 1 | 1 | V46 | V48 | V47(SYNTHESIZED) | |
| V48 | V48 | 4n + 1 | 0 | 0 | 1 | 1 | 0 | 0 | 0 | 0 | V48 | V48 | V48 | |
| V49 | — | — | 0 | 0 | 1 | 1 | 0 | 0 | 0 | 1 | V48 | V50 | V49(SYNTHESIZED) | |
| V50 | V50 | 4n + 3 | 0 | 0 | 1 | 1 | 0 | 0 | 1 | 0 | V50 | V50 | V50 | |
| V51 | — | — | 0 | 0 | 1 | 1 | 0 | 0 | 1 | 1 | V50 | V52 | V51(SYNTHESIZED) | |
| . | . | . | . | . | . | . | . | . | . | . | . | . | . | |
| . | . | . | . | . | . | . | . | . | . | . | . | . | . | |
| . | . | . | . | . | . | . | . | . | . | . | . | . | . | |
| V220 | V220 | 4n + 1 | 1 | 1 | 0 | 1 | 1 | 1 | 0 | 0 | V220 | V220 | V220 | |
| V221 | — | — | 1 | 1 | 0 | 1 | 1 | 1 | 0 | 1 | V220 | V222 | V221(SYNTHESIZED) | |
| V222 | V222 | 4n + 3 | 1 | 1 | 0 | 1 | 1 | 1 | 1 | 0 | V222 | V222 | V222 | |
| V223 | — | — | 1 | 1 | 0 | 1 | 1 | 1 | 1 | 1 | V222 | V224 | V223(SYNTHESIZED) | |
| V224 | V224 | — | 1 | 1 | 1 | 0 | 0 | 0 | 0 | 0 | V224 | V224 | V224 | AS SUPPLIED FROM |
| V225 | V225 | — | 1 | 1 | 1 | 0 | 0 | 0 | 0 | 1 | V225 | V225 | V225 | GRAY-SCALE |
| V226 | V226 | — | 1 | 1 | 1 | 0 | 0 | 0 | 1 | 0 | V226 | V226 | V226 | VOLTAGE SUPPLY |
| V227 | V227 | — | 1 | 1 | 1 | 0 | 0 | 0 | 1 | 1 | V227 | V227 | V227 | CIRCUIT |
| V228 | V228 | — | 1 | 1 | 1 | 0 | 0 | 1 | 0 | 0 | V228 | V228 | V228 | ↓ |
| V229 | V229 | — | 1 | 1 | 1 | 0 | 0 | 1 | 0 | 1 | V229 | V229 | V229 | |
| V230 | V230 | — | 1 | 1 | 1 | 0 | 0 | 1 | 1 | 0 | V230 | V230 | V230 | |
| V231 | V231 | — | 1 | 1 | 1 | 0 | 0 | 1 | 1 | 1 | V231 | V231 | V231 | |
| V232 | V232 | — | 1 | 1 | 1 | 0 | 1 | 0 | 0 | 0 | V232 | V232 | V232 | |
| V233 | V233 | — | 1 | 1 | 1 | 0 | 1 | 0 | 0 | 1 | V233 | V233 | V233 | |
| V234 | V234 | — | 1 | 1 | 1 | 0 | 1 | 0 | 1 | 0 | V234 | V234 | V234 | |
| V235 | V235 | — | 1 | 1 | 1 | 0 | 1 | 0 | 1 | 1 | V235 | V235 | V235 | |
| V236 | V236 | — | 1 | 1 | 1 | 0 | 1 | 1 | 0 | 0 | V236 | V236 | V236 | |
| V237 | V237 | — | 1 | 1 | 1 | 0 | 1 | 1 | 0 | 1 | V237 | V237 | V237 | |
| V238 | V238 | — | 1 | 1 | 1 | 0 | 1 | 1 | 1 | 0 | V238 | V238 | V238 | |
| V239 | V239 | — | 1 | 1 | 1 | 0 | 1 | 1 | 1 | 1 | V239 | V239 | V239 | |
| V240 | V240 | — | 1 | 1 | 1 | 1 | 0 | 0 | 0 | 0 | V240 | V240 | V240 | |
| V241 | V241 | — | 1 | 1 | 1 | 1 | 0 | 0 | 0 | 1 | V241 | V241 | V241 | |
| V242 | V242 | — | 1 | 1 | 1 | 1 | 0 | 0 | 1 | 0 | V242 | V242 | V242 | |
| V243 | V243 | — | 1 | 1 | 1 | 1 | 0 | 0 | 1 | 1 | V243 | V243 | V243 | |
| V244 | V244 | — | 1 | 1 | 1 | 1 | 0 | 1 | 0 | 0 | V244 | V244 | V244 | |
| V245 | V245 | — | 1 | 1 | 1 | 1 | 0 | 1 | 0 | 1 | V245 | V245 | V245 | |
| V246 | V246 | — | 1 | 1 | 1 | 1 | 0 | 1 | 1 | 0 | V246 | V246 | V246 | |
| V247 | V247 | — | 1 | 1 | 1 | 1 | 0 | 1 | 1 | 1 | V247 | V247 | V247 | |
| V248 | V248 | — | 1 | 1 | 1 | 1 | 1 | 0 | 0 | 0 | V248 | V248 | V248 | |
| V249 | V249 | — | 1 | 1 | 1 | 1 | 1 | 0 | 0 | 1 | V249 | V249 | V249 | |
| V250 | V250 | — | 1 | 1 | 1 | 1 | 1 | 0 | 1 | 0 | V250 | V250 | V250 | |

TABLE IV-continued

| GRAY-SCALE VOLTAGES | DECODER INPUT INPUT VOLTAGES | SERIAL NUMBERS (n = 0, 1 . . .) | DIGITAL INPUT BITS D7 | D6 | D5 | D4 | D3 | D2 | D1 | D0 | DECODER-SELECTED VOLTAGES Vin1 | Vin2 | AMP OUTPUT |
|---|---|---|---|---|---|---|---|---|---|---|---|---|---|
| V251 | V251 | — | 1 | 1 | 1 | 1 | 1 | 0 | 1 | 1 | V251 | V251 | V251 |
| V252 | V252 | — | 1 | 1 | 1 | 1 | 1 | 1 | 0 | 0 | V252 | V252 | V252 |
| V253 | V253 | — | 1 | 1 | 1 | 1 | 1 | 1 | 0 | 1 | V253 | V253 | V253 |
| V254 | V254 | — | 1 | 1 | 1 | 1 | 1 | 1 | 1 | 0 | V254 | V254 | V254 |
| V255 | V255 | — | 1 | 1 | 1 | 1 | 1 | 1 | 1 | 1 | V255 | V255 | V255 |

What is claimed is:

1. A liquid crystal display device including a liquid crystal panel having a plurality of pixels and a video signal line driver circuit for supplying a video signal voltage to each of said plurality of pixels via a corresponding one of a plurality of video lines in accordance with a display data comprising P bits, said video signal line driver circuit comprising:

a power supply circuit for supplying Q different gray-scale voltages;

a plurality of selector circuits corresponding to said plurality of video lines, each of said plurality of selector circuits for outputting one of first and second pairs of voltages in accordance with said display data, said first pair comprising two voltages equal to a same one selected from among said Q different gray-scale voltages, said second pair comprising two different voltages selected from among said Q different gray-scale voltages; and a plurality of amplifiers corresponding to said plurality of video lines, each of said plurality of amplifiers for outputting said video signal voltage to a corresponding one of said plurality of video lines based upon one of said first and second pairs of voltages or a voltage intermediate between said second pair of voltages and produced from said second pair of voltages in said amplifiers.

2. A liquid crystal display device according to claim 1, wherein each of said plurality of amplifiers outputs a voltage V1 if said first pair of voltages (V1, V1) are supplied, and each of said plurality of amplifiers outputs a voltage V2 intermediate between voltages V1 and V3 if said second pair of voltage (V1, V3) are supplied.

3. A liquid crystal display device according to claim 1, wherein each of said plurality of selector circuit includes P switching elements corresponding to said P bits of said display data, each of said display data is divided into a plurality of bit groups to select said first and second pairs of voltage.

4. A liquid crystal display device including a liquid crystal panel having a plurality of pixels and a video signal line driver circuit for supplying a video signal voltage to each of said plurality of pixels via a corresponding one of a plurality of video lines in accordance with a display data comprising P bits, said video signal line driver circuit comprising:

a power supply circuit for supplying Q different gray-scale voltages;

a plurality of selector circuits corresponding to said plurality of video lines, each of said plurality of selector circuits for outputting a plurality of voltages selected from among said Q different gray-scale voltages in accordance with said display data; and a plurality of amplifiers corresponding to said plurality of video lines, each of said plurality of amplifiers for outputting said video signal voltage to a corresponding one of said plurality of video lines based upon one of said plurality of voltages or a voltage different from said plurality of voltages and produced from said plurality of voltages in said amplifiers, in accordance with said display data.

5. A liquid crystal display device according to claim 4, wherein each of said plurality of selector circuit includes P switching elements corresponding to said P bits of said display data, each of said display data is divided into a plurality of bit groups to select said plurality of voltages from among said Q different gray-scale voltages.

6. A liquid crystal display device according to claim 4, wherein said Q different gray-scale voltages are divided into a plurality of groups, each of said plurality of selector circuits is configured so as to select a predetermined number of groups from among said plurality of groups and to select one voltage from each of said predetermined number of groups in accordance with said display data.

7. A liquid crystal display device including a liquid crystal panel having a plurality of pixels and a video signal line driver circuit for supplying a video signal voltage to each of said plurality of pixels via a corresponding one of a plurality of video lines in accordance with a display data comprising P bits, said video signal line driver circuit comprising:

a power supply circuit for supplying Q different gray-scale voltages;

a plurality of selector circuits corresponding to said plurality of video lines, each of said plurality of selector circuits for outputting one of first and second pairs of voltages in accordance with said display data, said first pair comprising two voltages equal to a same one selected from among said Q different gray-scale voltages, said second pair comprising two different voltages selected from among said Q different gray-scale voltages; and a plurality of amplifiers corresponding to said plurality of video lines, each of said plurality of amplifiers for outputting said video signal voltage to a corresponding one of said plurality of video lines by current-amplifying said first pair of voltages or current-amplifying a voltage intermediate between said second pair of voltages and produced from said second pair of voltages in said amplifiers, in accordance with said display data.

8. A liquid crystal display device according to claim 7, wherein said Q different gray-scale voltages are divided into a plurality of groups based upon a magnitude of a voltage difference between two successive gray-scale voltages, and each of said plurality of selectors is configured so as to output said first pair comprising two equal voltages if said display data represents a voltage in one of said plurality of groups in which the magnitude of said voltage difference is relatively great.

9. A liquid crystal display device according to claim 7, wherein each of said plurality of selectors is configured so as to output said first pair comprising two equal voltages if said display data represents a gray-scale voltage in a region where a relationship between gray-scale steps and gray-scale voltages among said Q different gray-scale voltages are not linear.

10. A liquid crystal display device according to claim 7, wherein each of said plurality of selectors is configured so as to output said first pair comprising two equal voltages if said display data represents a gray-scale voltage among a predetermined number R of gray-scale voltages at a higher end and a predetermined number S of gray-scale voltages at a lower end among said Q different gray-scale voltages arranged in order of magnitude.

11. A liquid crystal display device according to claim 7, wherein each of said plurality of selectors is configured so as to output said first pair comprising two equal voltages if said display data represents a gray-scale voltage among a predetermined number T of gray-scale voltages at a white end among said Q different gray-scale voltages arranged in order of a white display to a black display.

12. A liquid crystal display device according to claim 7, wherein each of said plurality of selectors is configured so as to output said first pair comprising two equal voltages if said display data represents a gray-scale voltage among a predetermined number U of gray-scale voltages at a black end among said Q different gray-scale voltages arranged in order of a white display to a black display.

13. A liquid crystal display device according to claim 7, wherein each of said plurality of selectors includes a first decoder supplied with gray scale voltages V(4n) (n=0, 1, 2, 3, . . . ) among said Q different gray-scale voltages arranged in order of magnitude, and a second decoder supplied with gray scale voltages V(4n+2) (n=0, 1, 2, 3, . . . ) among said Q different gray-scale voltages arranged in order of magnitude, and a switching element for opening or closing a circuit between outputs of said first and second decoders in accordance with a lowest-order bit of said display data.

* * * * *